United States Patent [19]

Ueno

[11] Patent Number: 4,527,917

[45] Date of Patent: Jul. 9, 1985

[54] ELECTRONIC 3-MODE TYPEWRITER/CALCULATOR WITH SPECIAL DEAD KEYS AND REPEAT KEYS

[75] Inventor: Hideo Ueno, Nagoya, Japan

[73] Assignee: Brother Kogyo Kabushiki Kaisha, Nagoya, Japan

[21] Appl. No.: 479,810

[22] Filed: Mar. 28, 1983

[30] Foreign Application Priority Data

Apr. 2, 1982 [JP] Japan ..... 57-55580
Apr. 2, 1982 [JP] Japan ..... 57-55581
Apr. 2, 1982 [JP] Japan ..... 57-55582

[51] Int. Cl.[3] ..... B41J 5/30

[52] U.S. Cl. ..... 400/70; 400/63; 400/78; 400/83; 400/120; 400/300; 400/472; 400/479; 340/365 R; 340/709; 364/705; 364/716

[58] Field of Search ..... 400/17, 70, 77, 78, 400/79, 83, 120, 110, 300, 301, 302, 368, 472, 369, 705, 479, 705.2, 63; 101/46; 235/61 PH, 61 PK, 59 BF, 59 T, 60 TW, 60.12, 102; 340/709, 711, 762, 782, 825.55, 825.65, 825.79, 825.82, 365 R; 364/189, 519, 521, 523, 705, 716

[56] References Cited

U.S. PATENT DOCUMENTS

| | | | |
|---|---|---|---|
| 3,199,446 | 8/1965 | Schaaf | 400/110 X |
| 3,920,979 | 11/1975 | Kilby et al. | 364/705 |
| 3,940,758 | 2/1976 | Margolin | 340/365 R |
| 3,976,840 | 8/1976 | Cleveland et al. | 340/365 R X |
| 4,330,776 | 5/1982 | Dennison, Jr. et al. | 340/365 R |
| 4,389,641 | 6/1983 | Nakanishi et al. | 340/709 |
| 4,392,758 | 7/1983 | Bowles et al. | 400/17 X |
| 4,405,244 | 9/1983 | Holmes, Jr. | 400/301 X |

FOREIGN PATENT DOCUMENTS

| | | | |
|---|---|---|---|
| 1126169 | 3/1962 | Fed. Rep. of Germany | 400/78 |
| 2945270 | 6/1981 | Fed. Rep. of Germany | 400/83 |
| 0134929 | 10/1979 | Japan | 400/83 |
| 0073576 | 6/1980 | Japan | 400/77 |
| 0164178 | 12/1980 | Japan | 400/78 |
| 0114060 | 9/1981 | Japan | 364/705 |
| 2029055 | 3/1980 | United Kingdom | 364/705 |

OTHER PUBLICATIONS

IBM Technical Disclosure Bulletin, "Multiple Overstrike Printing Method", Maholick et al., vol. 22, No. 8B, Jan. 1980, pp. 3786–3788.

IBM Technical Disclosure Bulletin, "Pairing of Escaping and Non-Escaping Characters on the same Key in Electronic Entry Keyboards" Motola, vol. 24, No. 11B, Apr. 1982, p. 5858.

*Primary Examiner*—Ernest T. Wright, Jr.
*Attorney, Agent, or Firm*—Browdy and Neimark

[57] ABSTRACT

An electronic typewriter having calculating, displaying and editing capabilities as well as printing capability. The typewriter includes a main control device having three different modes in which the typewriter is operated. In the first mode, the control device performs an arithmetic operation which is defined in a statement including letters, at least one arithmetic symbol and plural numerical values entered through letter, numeral and arithmetic symbol keys. Further, in the first mode, the control device directs a display device to display the statement and a result of the arithmetic operation, and permits the displayed characters to be edited for correction or change. In the second mode, the control device permits the above items of operation in the first mode and directs a printing device to print the displayed characters. The third mode enables the typewriter to display entered characters and print the characters as they are entered and displayed.

18 Claims, 22 Drawing Figures

FIG. 10
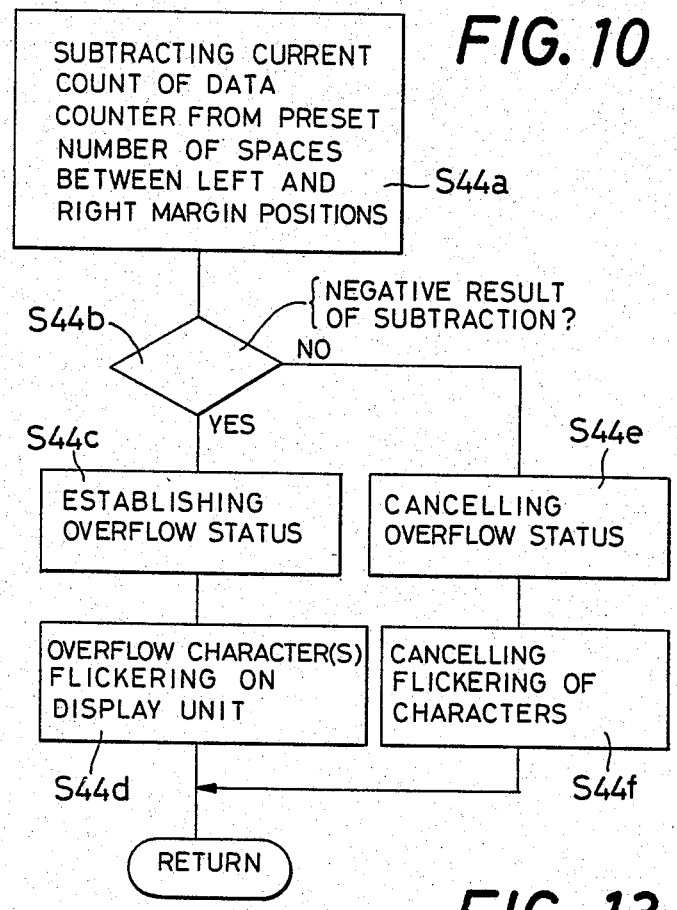
FIG. 14
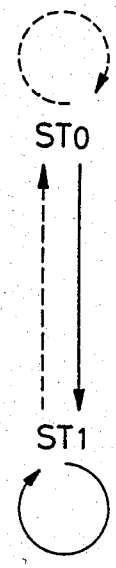
FIG. 13
| KEY ENTRIES IN THE ORDER FROM LEFT TO RIGHT | | | | | | | DISPLAYED OR PRINTED CHARACTERS |
|---|---|---|---|---|---|---|---|
| ¨ | ´ | | | | | | ´ |
| ¨ | A | | | | | | Ä |
| ¨ | B | | | | | | B |
| ¨ | ~ | N | | | | | Ñ |
| ´ | U | | | | | | Ú |
| ´ | ` | ¨ | ~ | ^ | ´ | I | Í |

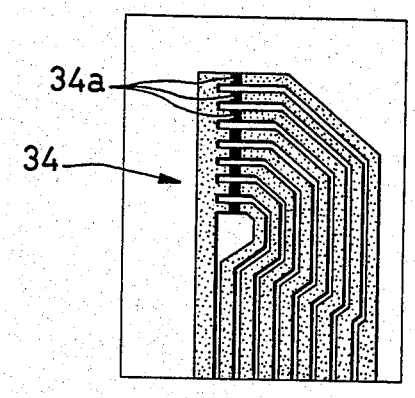
FIG. 17
FIG. 18
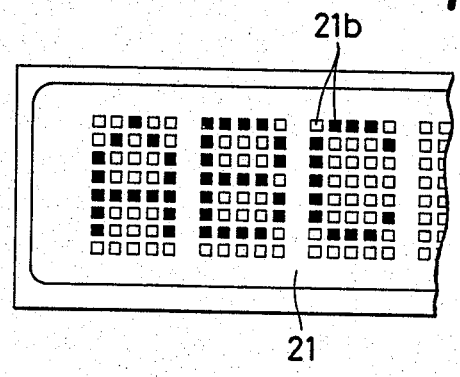

ELECTRONIC 3-MODE TYPEWRITER/CALCULATOR WITH SPECIAL DEAD KEYS AND REPEAT KEYS

BACKGROUND OF THE INVENTION

The present invention relates generally to an electronic typewriter having calculating and displaying capabilities, and more particularly to an electronic typewriter which is capable of: displaying and editing a succession of characters which are entered through a keyboard and which include numerals and one or more arithmetic operator symbols designating an arithmetic operation; capable of performing the designated arithmetic operation; and further capable of printing a result of the arithmetic operation as well as the entered statement.

In a known electronic typewriter, it is possible to print desired characters such as alphabetic letters and numerals which are entered through a keyboard. Such printing may be effected on a desired kind of paper, for example, on a form with spaces left for the insertion of information, by way of moving a carriage along a line of printing to fill the spaces with desired information. The information to be inserted may often contain an arithmetic statement including numerical values, and an arithmetic symbol to designate a kind of mathematical operation. In such instance, it is required to solve a mathematical problem which is defined by such arithmetic statement, and to print a result of the arithmetic operation together with the entered arithmetic statement. Thus, the operator of the typewriter has to use a desktop or portable electronic calculator for obtaining the arithmetic result and then enter the obtained result so that the result is printed following the arithmetic statement. Those steps of calculation and additional data entry will require extra time and consequently reduce printing efficiency.

On the other hand, commonly used desktop calculators are capable of calculating according to entries of numerical data and an arithmetic symbol, and displaying the arithmetic expression including the result of the calculation. However, those calculators suffer low printing capability and recordability in terms of usable characters and print paper, as well known in the art.

To meet the above stated requirement and overcome the drawbacks recognized in the art of calculating, displaying and printing an arithmetic expression, the present applicant developed an electronic typewriter having calculating capability, which is the subject matter of a copending U.S. application Ser. No. 426,136 filed Sept. 28, 1982, the disclosure of which is hereby incorporated by reference.

The typewriter disclosed in the above identified application is capable of performing an arithmetic operation which is defined by an arithmetic symbol or symbols and numerical values entered in the form of combined numerals and letters, and which is further capable of displaying and printing a result of the arithmetic operation following the entered arithmetic statement. This typewriter is constructed to comprise: a keyboard; arithmetic means for performing an arithmetic operation designated by at least one of the arithmetic operator keys, based on plural sets of numerical data each representing a numerical value and entered through numeral keys; main control means for selecting the numerical data as operands from among successive sets of data entered through the letter, numeral and arithmetic symbol keys including an equality key as well as the arithmetic operator keys, such that only the set of numerical data which is entered last prior to each operation of any one of the arithmetic symbol keys is regarded as one of the operands, the main control means directing the arithmetic means to perform the arithmetic operation based on the selected sets of numerical data, and reading out a result of the arithmetic operation from the arithmetic means; and a printing device printing a succession of characters entered by the letter, numeral and arithmetic symbol keys, and the result of arithmetic operation read out by the main control means, the result being printed following the entered succession of letters. The above typewriter may further include a display unit which indicates the entered characters.

In the typewriter having the above arrangement, the entered characters are printed as they are shifted out of the display unit after the display unit has overflowed with the entered characters, and the displayed characters are all printed when a carriage return key is depressed. More specifically, leading characters on the display unit are automatically printed one after another when subsequent entries of characters have overflowed the display unit. This means that the entered data may not be corrected or edited after the digit capacity of the display unit has been reached, because the previously entered characters have been already printed. Further, the automatic printing of the above arrangement will prevent the typewriter from being used simply as an ordinary electronic calculator when it is desired to merely obtain a result of a mathematical statement or expression without having to print out the result of calculation as well as the entered statement. Another inconvenience experienced on the same typewriter lies in that the entered characters may not be printed as soon as they have been entered as in an ordinary typewriter.

SUMMARY OF THE INVENTION

It is accordingly an object of the present invention to provide an improved electronic typewriter which has calculating, displaying and editing capabilities as well as printing capability, and which has increased calculating and printing efficiency, enhanced operationability, and improved recordability of information with minimum error.

Another object of the invention is to provide an electronic typewriter which has calculating and displaying capabilities and which has three different modes of operation: a first mode in which it is possible to perform an arithmetic operation, to display a result of the arithmetic operation as well as an arithmetic statement defining the arithmetic operation, and to edit the displayed arithmetic statement; a second mode in which it is possible to print the arithmetic statement and the arithmetic result, as well as to perform the first mode of operation; and a third mode in which it is possible to print a succession of characters as they are entered through the keyboard.

A further object of the invention is to provide the above stated electronic typewriter, which is further capable of correctly printing special letters such as Ä, Í and Ñ each of which is a combination of a special symbol and a letter.

A still further object of the invention is to provide an electronic typewriter which has calculating, displaying, editing and printing capabilities, and which is capable of preventing unnecessary power consumption thereof when self-repeat keys are kept depressed for more than a reasonable period of time.

According to the present invention, there is provided an electonic typewriter having calculating, displaying and editing capabilities as well as printing capability. The typewriter comprises a keyboard having a multiplicity of keys including letter keys, numeral keys, arithmetic operator keys, and function keys including an equality key. The keyboard generates code signals corresponding to the keys when they are depressed. The typewriter is provided with a photoelectric display device indicating characters corresponding to the letter, numeral and arithmetic symbol keys, and a printing device printing the characters along a line of printing. The typewriter further comprises main control means which is connected to the keyboard, and the display and printing devices. The main control means processes the code signals in one of a first mode, a second mode and a third mode to supply to the display and printing devices sets of pattern data corresponding to the code signals. The first, second, and third modes are selectively established by manually operated means provided on the typewriter. The main control means, when placed in the first mode, performs an arithmetic operation which is defined in a statement including letters, at least one arithmetic operator and plural numerical values entered through the letter, numeral and arithmetic operator keys, respectively. In the first mode, the main control means directs the display device to display the statement and a result of the arithmetic operation, and permits the displayed statement and the result to be edited for correction and/or change thereof. When the main control means is placed in the second mode, it permits the above items of operation in the first mode and directs the printing device to print the statement and the result of the arithmetic operation. The main control means, when placed in the third mode, directs the printing device to print the characters as the characters are entered.

The electronic typewriter constructed as described above according to the present invention, can be used in the first mode as an ordinary desktop electronic calculator merely for calculating purpose. In the second mode, the entered and displayed statement including an arithmetic expression can be printed, after editing thereof if necessary, together with a result of the calculation. The third mode enables the typewriter to be used as an ordinary electronic typewriter which effects printing of characters as they are entered independently of the first and second modes of operation. Thus, the typewriter of the invention is improved in calculating and printing efficiency, operationability and recordability of information.

BRIEF DESCRIPTION OF THE DRAWINGS

The above and other objects, features and advantages of the present invention will become more apparent from reading the following description of the preferred embodiments taken in connection with the accompanying drawing in which:

FIGS. 5A through 12 are flow charts illustrating operations of the typewriter;

FIG. 13 is a fragmentary illustration of a table showing actually displayed or printed characters in relation to different combinations of special symbols and letters;

FIG. 14 is a diagrammatic representation of transitions of current states of entry keys responsive to their operation between depressed and released positions;

FIGS. 16, 17 and 18 are enlarged views showing parts of the typewriter of FIG. 1.

DETAILED DESCRIPTION OF THE PREFERRED EMBODIMENTS

Figure 1:
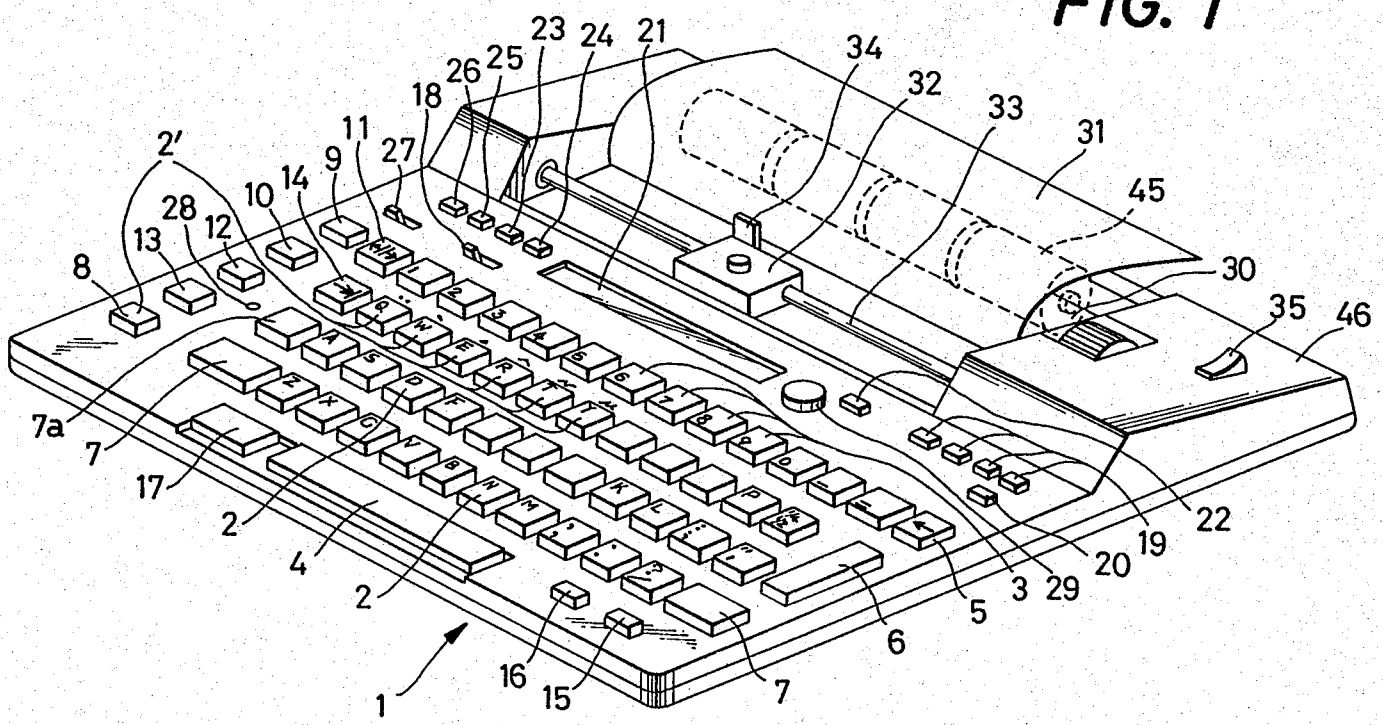
FIG. 1 is a schematic illustration in perspective of an embodiment of an electronic typewriter according to the present invention.

Referring to FIG. 1, there is shown in perspective an electronic typewriter according to the invention wherein a keyboard 1 includes:

a multiplicity of letter keys 2 corresponding to alphabetic letters;

a plurality of numeral keys 3 corresponding to numerals or digits;

a space bar 4 for advancing a carriage 32 (described later) one space (corresponding to a width of a character) at a time along a line of printing without entry of characters through the letter and numeral keys 2 and 3, and other keys;

a backspace key 5 for retracting or reversing the carriage 32 one space at a time along the printing line without the entry of characters;

a carriage return key 6 for returning the carriage 32 to a left margin position and rotating a platen 30 (described later) to advance a sheet of paper 31 on the platen 30 one line space at a time in a direction normal to the printing line;

shift keys 7 for selecting upper-case or lower-case positions of the letter and numeral keys 2 and 3, and other keys;

another shift key 8 for selecting positions of special symbols such as " " (Umlaut) and " " (accent circonflexe) disposed on the letter and numeral keys 2 and 3;

left and right margin keys 9 and 10 for setting left and right margin positions, respectively, to determine a length of the printing line;

a margin release key 11 for cancelling the left and right margin positions set by the left and right margin keys 9 and 10, which key 11 is effective only in a single printing line currently selected;

a tab setting key 12 for setting desired tabulation positions within the length of the printing line determined by the left and right margin keys 9 and 10;

a tab clear key 13 for cancelling the tabulation positions set by the tab setting key 12;

a key tab 14 for moving the carriage 32 to the tabulation positions set by the tab setting key 12;

a paper forward key 15 for feeding a sheet of paper 31 one line space at a time in a forward direction normal to the printing line;

a paper backward key 16 for feeding a sheet of paper 31 one line space at a time in a backward direction normal to the printing line; and a repeat key 17 for permitting repeated execution of functions assigned to the letter and numeral keys 2 and 3, space bar 4, backspace key 5, carriage return key 6, paper forward and backward keys 15 and 16 which are actuated once prior to depression of the repeat key 17.

The keyboard 1 of the typewriter further includes a manually operated mode selection switch 18 for selecting one of three possible modes of operation of the typewriter, which modes comprise:

a first mode in which it is possible: to perform an arithmetic operation designated by at least one of arithmetic operator keys 19 (described later) according to an arithmetic statement including numerical data as operands, letter characters as identification of the numerical data, and arithmetic operators, respectively entered through the letter, numeral and arithmetic operator keys 2, 3 and 19; to display the result of the arithmetic operation as well as the arithmetic statement including an equality symbol; and further to edit the displayed statement including the result of the operation;

a second mode in which it is possible to perform the above items of operation, and print the above described statement and the result of the arithmetic operation; and a third mode in which it is possible to simultaneously display and print letters, numerals and symbols which have been entered through the appropriate keys.

The arithmetic operator keys 19 are used, when the first or second mode is selected by the mode selection switch 18, to designate a desired arithmetic operation, i.e., addition, subtraction, multiplication or division of plural sets of numerical data entered through the numeral keys 3.

The keyboard 1 further includes:

an equality key 20 which directs to complete an arithmetic operation designated by the appropriate arithmetic operator key or keys 19;

a liquid crystal display unit 21 of desired digits which indicate, in 5×8 dot-matrix, characters including arithmetic symbols entered by the arithmetic operator keys 19 and the equality key 20, and numerical data including a result of an arithmetic operation;

a clear key 22 for deleting all characters displayed on the display unit 21;

cursor keys 23 and 24 used in the first or second mode for moving a cursor 21*a* to a desired digit position on the display, causing a character at the cursor position to flicker, and permitting an editing operation at that cursor position;

a delete key 25 for deleting a character at a position of the cursor 21*a* which is moved by the cursor keys 23 and 24;

an insert key 26 for inserting a character or characters at the cursor position and at more significant digit position or positions with respect to the cursor position, and thereby shifting toward the most significant digit position those characters which have been displayed at the more significant positions with respect to the cursor position; and a line space selection switch 27 for selecting a space distance between adjacent lines.

On the keyboard 1, there is also provided a shift lock key 7*a* for maintaining the upper-case position of the character keys 2, 3. Upon depression of the shift lock key 7*a*, a light emitting diode 28 adjacent the key 7*a* is illuminated to indicate that the upper-case position is currently selected.

It is noted that the carriage return key 6, paper forward key 15, paper backward key 16 and repeat key 17 have a self-repeating capability of repeating their assigned functions when they are kept depressed, that is, a continuous depression of the key 6, 15, 16 causes repeated carriage return motions or continuous paper feeding motions in the appropriate directions, and a continuous depression of the repeat key 17 causes repeated execution of a key depressed immediately before the key 17.

The keyboard 1 also carries a brightness adjusting dial 29 for establishing a desired brightness of the display unit 21. A rotary movement of the dial 29 changes a level of voltage applied to liquid crystals of the display elements and thereby alters the arrangement of the crystals to modify the brightness.

Figure 16:
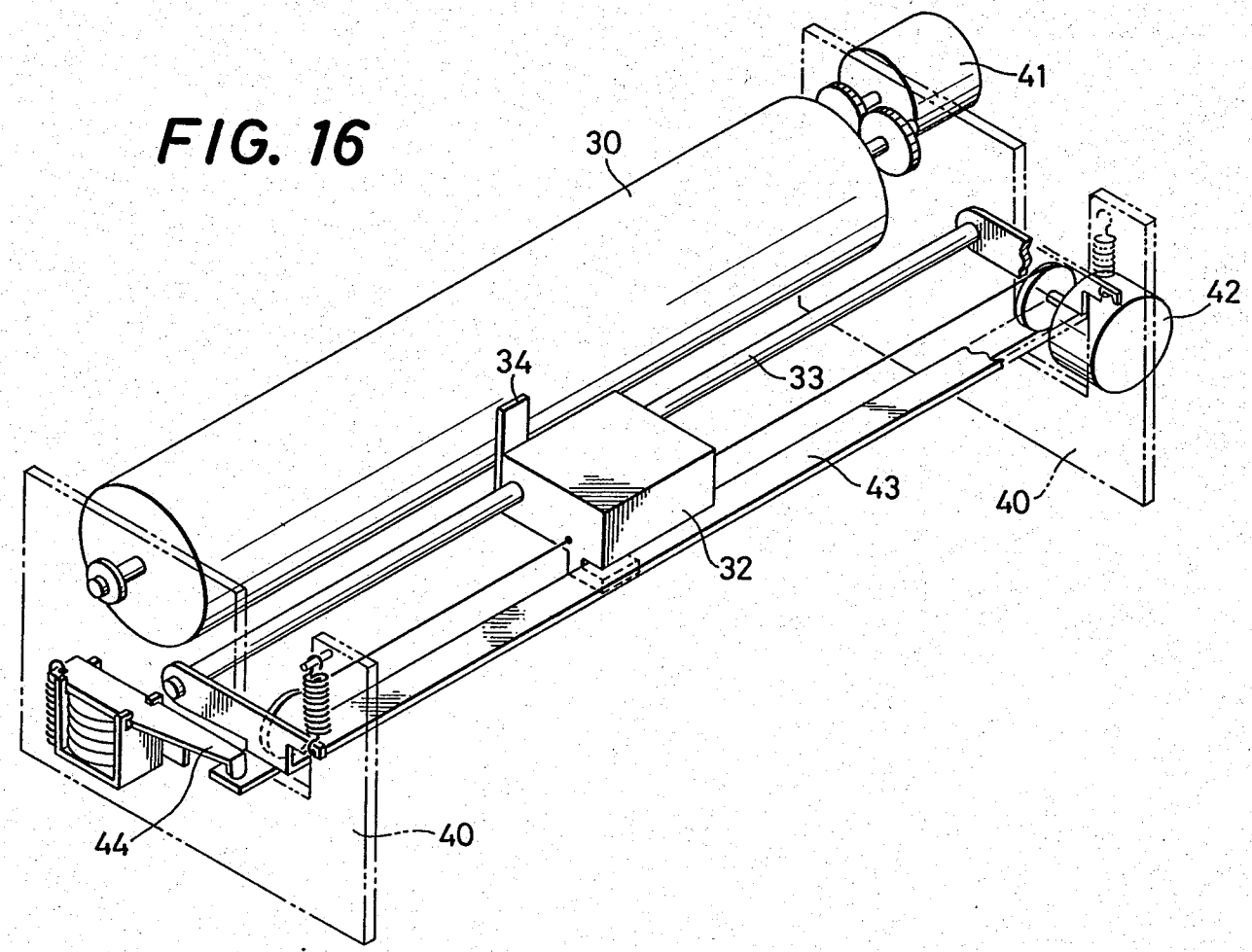

Referring further to FIG. 16, the platen 30 is rotatably supported by a main frame 40 of the typewriter to support thereon a sheet of heat-sensitive paper 31 containing a color development layer which is colored through exposure to heat. The platen 30 is rotated by a paper feed stepper motor 41 in a forward or backward direction normal to the printing line.

The carriage 32 is disposed such that it is reciprocatingly movable by a carriage drive stepper motor 42 relative to and along a guide rod 33 secured to the main frame 40 and extending in parallel to the printing line, and relative to an oscillatable rod 43 connected to a link mechanism 44.

Referring further to FIG. 17, the carriage 32 carries a thermal print head 34 which has a plurality of heat generating elements 34*a* arranged in a direction normal to the printing line. Upon printing of characters, the thermal print head 34 is brought into contact with a printing surface of the heat-sensitive paper sheet 31 and their heat generating elements 34*a* are selectively actuated to print the characters, for example, in the form of a 5×8 dot-matrix.

The typewriter is powered by a battery 45 accommodated at the rear of the platen 30. The battery power is applied to the typewriter when a power disconnect switch 35 provided in a typewriter casing 46 is turned on.

Figure 2:
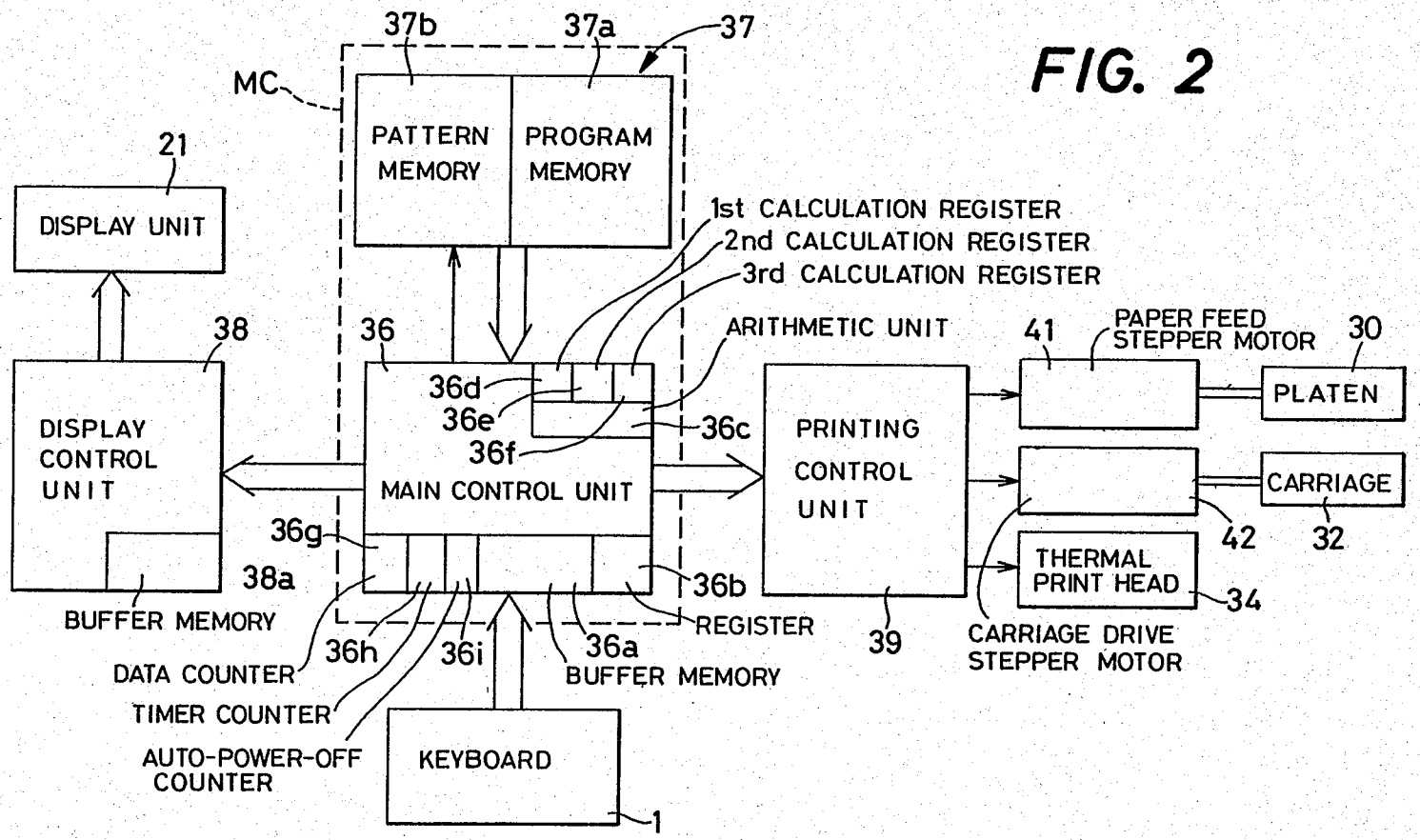
FIG. 2 is a schematic block diagram showing an electronic arrangement of the typewriter of FIG. 1.

Referring next to FIG. 2 which is a schematic block diagram, there is shown an electronic arrangement of the typewriter of the invention wherein the keyboard 1 serving as an input device is connected to a one-chip microcomputer MC indicated in broken lines in the figure, which includes a main control unit 36 and a read-only-memory (hereinafter abbreviated as ROM) 37. The main control unit 36 is connected to a display control unit 38 which is connected to the display unit 21. The main control unit 36 is further connected to a printing control unit 39 to control the stepper motors 41 and 42 for the platen 30 and the carriage 32, and the print head 34. These components 30, 32 and 34 cooperate to constitute a printing device. The main control unit 36 includes a buffer memory 36*a*, a register 36*b*, and an arithmetic unit 36*c* which has a first calculation register 36*d*, a second calculation register 36*e* and a third calculation register 36*f*. The buffer memory 36*a* is, for example, a random access memory into which are sequentially written code data corresponding to the keyboard keys which are operated. The buffer memory 36*a* has the same digit capacity as the display unit 21. The ROM 37 includes a program memory 37*a*, and a pattern memory 37*b* which stores pattern data corresponding to the letter keys 2, numeral keys 3 and other keys. The display control unit 38 includes a buffer memory 38*a* which has the same digit capacity as the display unit 21.

Figure 3:
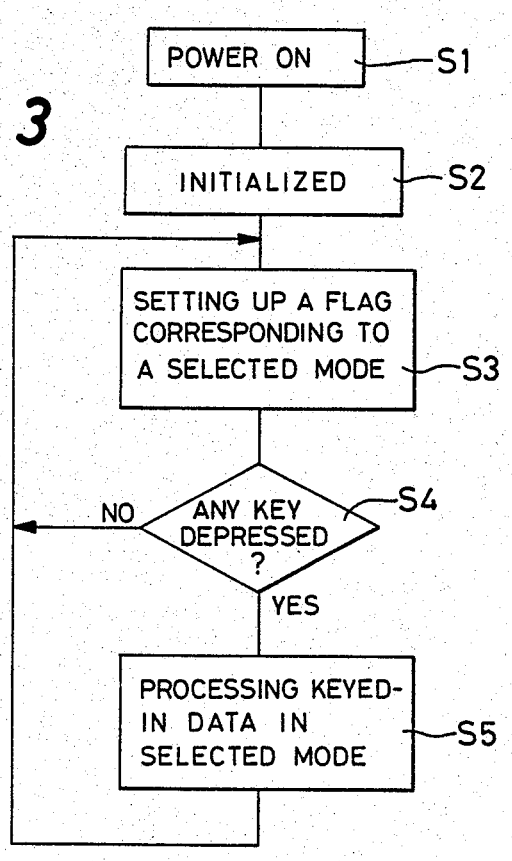
FIG. 3 is a flow diagram representing a basic sequence of operation of the typewriter.
Figure 4:
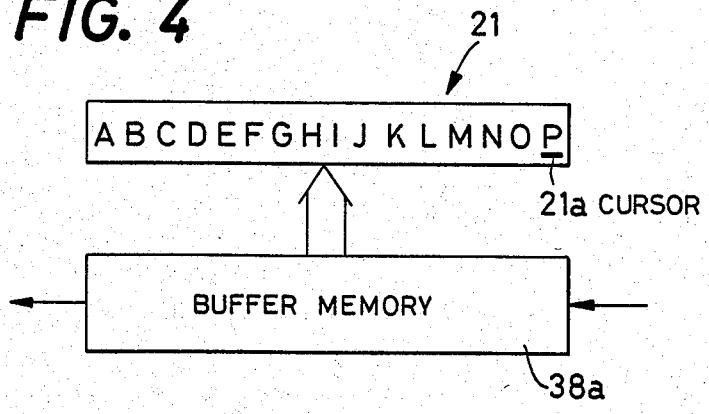
FIG. 4 is a view showing a buffer memory used in a display control unit of the typewriter.

Referring to FIGS. 3 and 4 in addition to FIG. 2, the basic sequence of operation of the present typewriter is described below.

When the power disconnect switch 35 is turned on (S1), the carriage 32 is returned to its home position and the display unit 21 and other devices are initialized (S2). Subsequently, the main control unit 36 sets up a flag corresponding to one of the first, second and third modes of operation selected by the mode selection switch 18, and designates, according to the set-up flag, one of programs which are written in the program memory 37*a* of the ROM 37, the designated program corresponding to the selected mode of operation (S3).

In the next step, the main control unit 36 judges whether any key on the keyboard 1 has been depressed (S4). When no data entry through a keyboard key has been made, the control goes back to the previous step S3 to set up a mode flag.

When any data entry through the keyboard 1 has been made, the main control unit 36 writes or stores in the buffer memory 36*a* code data corresponding to the depressed key. Based on the written code data, the main control unit 36 then takes an access to the pattern memory 37*b* to read therefrom the pattern data corresponding to the depressed key, and sends the read-out pattern data to the display control unit 38 (S5).

In the meantime, the main control unit 36 sends to the printing control unit 39 the pattern data of the depressed key according to the code data which has been shifted out of the buffer memory 36*a* when the second mode is selected, or which has been written into the buffer memory 36*a* when the third mode is selected. In other words, the printing control unit 39 receives, while in the second mode, the first set of pattern data only after the buffer memory 36*a* has overflowed, i.e., after the digit capacity thereof has been reached. On the other hand, sets of pattern data are sent, while in the third mode, to the printing control unit 39 as the corresponding sets of code data are written in the buffer memory 36*a*.

The display control unit 38 which receives the pattern data from the main control unit 36, stores plural sets of the pattern data into its buffer memory 38*a* with the data sequentially shifted toward the most significant digit. Further, the display control unit 38 scans the stored sets of pattern data to supply them to the display elements 21*b* at the corresponding digit positions of the display unit 21 so that the keyed-in characters corresponding to the sets of pattern data are displayed in the 5×8 dot-matrix at the respective digit positions of the display unit 21.

The printing control unit 39 which also receives the pattern data from the main control unit 36, directs the carriage 32 to move in steps along the printing line as well as selectively activate the heat generating elements 34*a* of the thermal print head 34 so as to permit a 5×8 dot-matrix thermal printing of the keyed-in characters on the sheet of paper 31 according to the pattern data.

The operation of the present typewriter in each of the three modes is hereinafter described in greater detail with reference to the FIGS. 5A through 15.

At first, there is described the first mode of operation which is selected when it is desired to perform an arithmetic operation defined by a keyed-in mathematical statement including plural sets of numerical data representing operands, and at least one arithmetic symbol representing an arithmetic operator which designates the arithmetic operation.

When the first mode is selected by the mode selection switch 18 which generates an appropriate selection signal, a flag corresponding to the first mode is set up in the main control unit 36, and the unit 36 has an access to the first address of a storage area of the program memory 37*a* in which the program corresponding to the first mode has been stored. Then, the first mode of operation is sequentially performed as described below according to the first mode program. Since the first mode is initially selected, a negative judgement is obtained in step S6 (FIG. 5A) wherein the control unit 36 checks whether the mode has been changed from one mode to another, and therefore the control goes to step S7 in which the control unit 36 checks if any key on the keyboard 1 has been depressed or not.

In step S8, the control unit 36 checks whether keyed-in data is display data corresponding to the letter keys 2, numeral keys 3, space bar 4, arithmetic operator keys 19, etc., or function data corresponding to the function keys including backspace key 5, carriage return key 6, tab key 14, equality key 20, etc. When the keyed-in data is not the function data, the control unit 21 checks if the code data representing the depressed key can be stored in the buffer memory 36*a* or not (S9).

When the entry of the code data is possible and the code data is stored in the buffer memory 36*a*, the pattern data corresponding to the stored code data is written into the buffer memory 38*a* (S11), and the character which has been entered through the letter, numeral or arithmetic operator key 2, 3 or 19 and which corresponds to the written pattern data; is displayed in the 5×8 dot-matrix (S12). Similarly, the following characters are displayed with spaces given by the space bar 4 at appropriate positions.

Each time one character or space has been displayed or given on the display unit 21, a data counter 36*g* is advanced to count the number of data entries (characters and spaces) (S14) and thereby check whether the counted number exceeds the digit capacity of the buffer memory 36*a* (S17). Step S17 is preceded by step S15 wherein the main control unit 36 checks if the third mode is selected or not. When the digit capacity of the buffer memory 36*a* is reached (the code data overflows the buffer memory 36*a*), the code data shifted out of the buffer memory 36*a* is stored as print data in the register 36*b* and an access is given to the pattern data corresponding to the stored code data (S18). Then, the main control unit 36 checks whether the code data stored in the register 36*b* is numerical data or not (S19).

When the code data is numerical data, it is stored as a first or second operand in the first or second calculation register 36*d* or 36*e* of the arithmetic unit 36*c* (S20). Then, the main control unit 36 goes to step S21 to check if the first mode is selected or not, and then goes back to the START position because the first mode is now selected. The next data entry is displayed according to the corresponding code data and pattern data as described above.

The above step S20 is described in more detail in copending application, Ser. No. 426,136, filed Sept. 28, 1982 in the name of the present applicant, the disclosure of which is hereby incorporated by reference.

Briefly stated, the first numerical data representing, for example, a numeral "2" is temporarily stored as a first operand in the first calculation register 36*d* of the arithmetic unit 36*c*. If this numerical data is immediately followed by another numerical data representing for example a numeral "3", this data is also stored in the first calculation register 36*d* such that it cooperates with the preceding numerical data to constitute a set of data representing the first operand, i.e., a numerical value "23". If another set of numerical data representing for example a numerical value "100" is entered following any data corresponding to the space bar 4 or letter keys 2 which has or have been operated after the entry of previous set of numerical data, said another set of numerical data "100" is stored, in place of the previous set of data "23", in the first calculation register 36*d*. When a third set of numerical data representing for example "10" is entered after any one of the arithmetic operator keys 19, for example, the multiplication key "×" has been operated, that third set of data "10" is temporarily stored as a second operand in the second calculation register 36*e* of the arithmetic unit 36*c*. If a fourth set of numerical data is entered following the code data representing an arithmetic operator, the above indicated multiplying operation of the first and second operands "100" and "10" in the first and second calculation registers 39*d* and 36*e* is first solved and then the result "1000" is stored in the first calculation register 36*d*, and the fourth set of numerical data is stored in the second calculation register 36*e*.

When the code data is judged, in the previously indicated step S8, to be function data corresponding to the cursor key 23 to move the cursor 21*a* to the left (S28, S30, FIG. 6A), an edit mode is established with the cursor 21*a* flickering on the display unit 21 (S32) if the edit mode has not been established (S31). Then, the cursor 21*a* is shifted one digit to the left or toward the most significant digit (S33).

The code data corresponding to the keys depressed after the cursor key 23 (S32, S10) is written in a digit position of the buffer memory 36*a* corresponding to the cursor position on the display unit 21, and the pattern data in the pattern memory 37*b* corresponding to the written code data is stored in the corresponding digit position of the buffer memory 38*a* (S23).

After the above data entry has been completed, the main control unit 36 judges whether the cursor 21*a* is located at the 0-digit position or not (S24). When the cursor 21*a* is at the 0-digit position, the edit mode is cancelled (S25) and the character previously displayed at the digit positions designated by the cursor 21*a* is replaced by the newly keyed-in character (including a space) represented by the pattern data stored in the buffer memory 38*a* in the edit mode (S27).

In the case where the above judgement in step S24 reveals that the cursor 21*a* is not located at the 0-digit position, the cursor 21*a* is shifted to the right or toward the least significant digit (S26) and the newly keyed-in character is displayed in place of the previously displayed character in the corresponding cursor position on the display unit 21 (S27). By repeating this operation of the cursor 21*a* shifting to the right and the data entry, the currently displayed characters are sequentially replaced by the newly keyed-in characters.

When the cursor key 24 to move the cursor 21*a* to the right is depressed after the edit mode has been established by the left cursor key 23 (S34, S35), the main control unit 36 checks if the cursor 21*a* is located at the 0-digit position on the display unit 21 or not (S36). The edit mode is cancelled when the cursor 21*a* is at the 0-digit position (S37).

When the cursor 21*a* is not located at the 0-digit position, it is shifted to the right (S38). In this condition, the newly keyed-in character replaces the previously displayed character in the same manner as described above.

When the delete key 25 is depressed while the edit mode is established (S39), the code data and the pattern data at the digit position of the respective buffer memories 36*a* and 38*a* corresponding to the cursor position on the display unit 21 are deleted (S40), and the code and pattern data stored at the more significant digit positions of the memories 36*a* and 38*a* are shifted one position to the right or toward the least significant digit position (S41). In response to the rightward shifting of the code and pattern data, the data counter 36*g* is reversed to reduce the current count thereof (S43) if the main control unit 36 is not placed in the first mode (S42), and the updated count of the data counter 36*g* is subtracted from a preset number of spaces between the left and right margin positions set by the margin keys 9 and 10 (S44). As shown in FIG. 10 in more detail, the result of the subtraction (S44*a*) which is a difference between the current count and the preset number of spaces is checked in step S44*b* to see if the result is negative or not. When the result is negative, an overflow status of one printing line is set (S44*c*) and the character or characters corresponding to the overflowing code or pattern data are made to flicker on the display unit 21 (S44*d*). When the result is positive, on the other hand, the overflow status is reset (S44*e*) and the character or characters which has been flickering are displayed in the normal manner (S44*f*). Upon completion of the above step S44, the control goes to the previously discussed step S36 wherein the 0-digit position of the cursor 21*a* is checked, and to the step S37 when cursor 21*a* is located at the 0-digit position. After cancellation of the edit mode, the control returns to the START position. When the cursor 21*a* is not at the 0-digit position, it is shifted to the right (S38) and the control returns to the START position.

On the other hand, when the insert key 26 is depressed while in the edit mode (S45), the code and pattern data at the more significant digit positions of the memories 36*a* and 38*a* are shifted one position to the left or toward the most significant digit position (S46), the cursor 21*a* is shifted one position to the left (S47), and the code and pattern data corresponding to the space bar 4 are stored at the respective positions of the memories 36*a* and 38*a* corresponding to the cursor position. After the data counter 36*g* is advanced as previously described in step S14, the code and pattern data representing a space are replaced by the code and pattern data corresponding to a desired key which has been depressed following the insert key 26 in the edit mode. Thus, an insertion of a letter or other character can be achieved.

Figure 7:
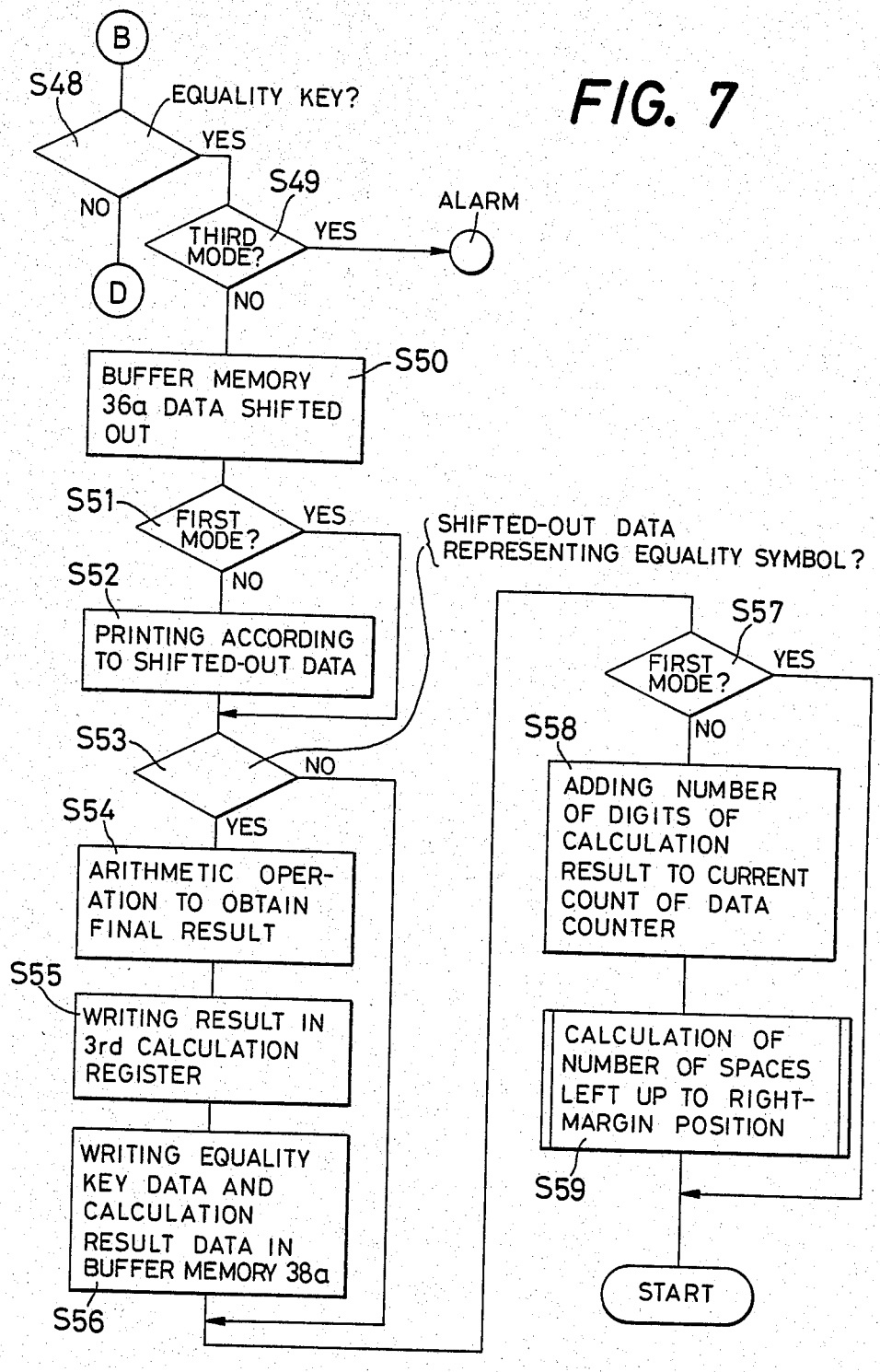

Referring to FIG. 7, there is described the operation of the typewriter upon depression of the equality key 20 in the first mode.

Figure 5A:
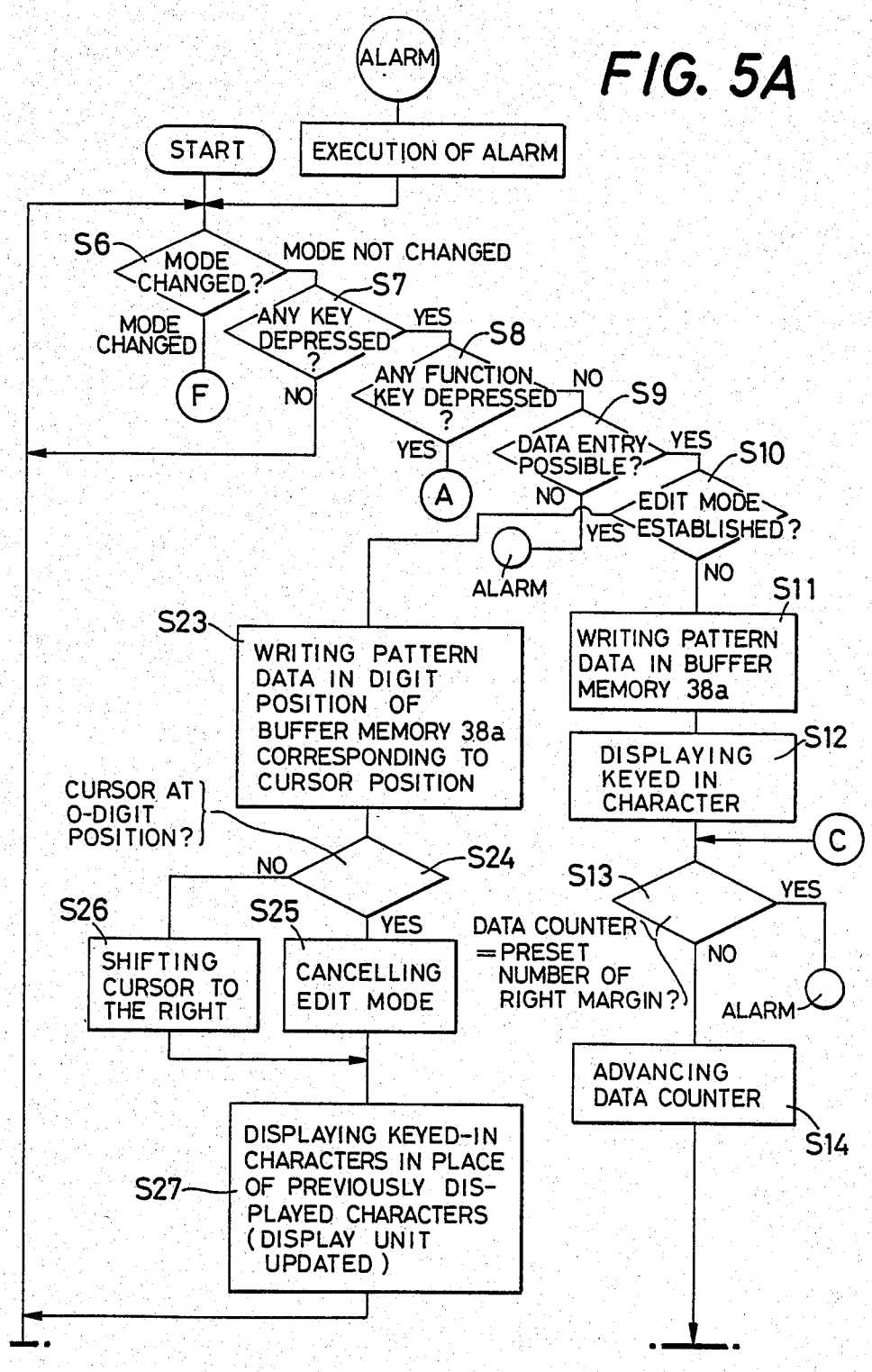
Figure 5B:
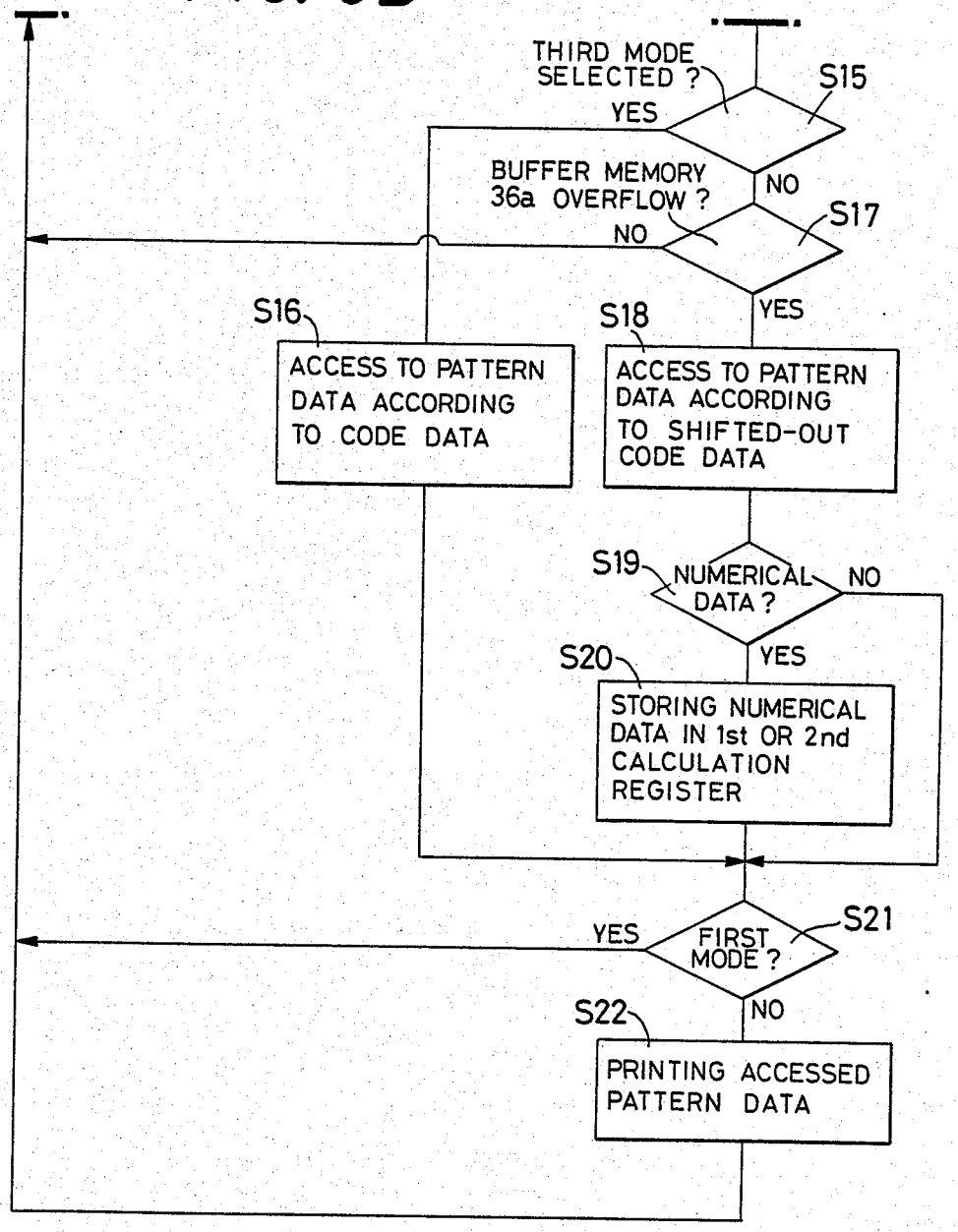
Figure 6A:
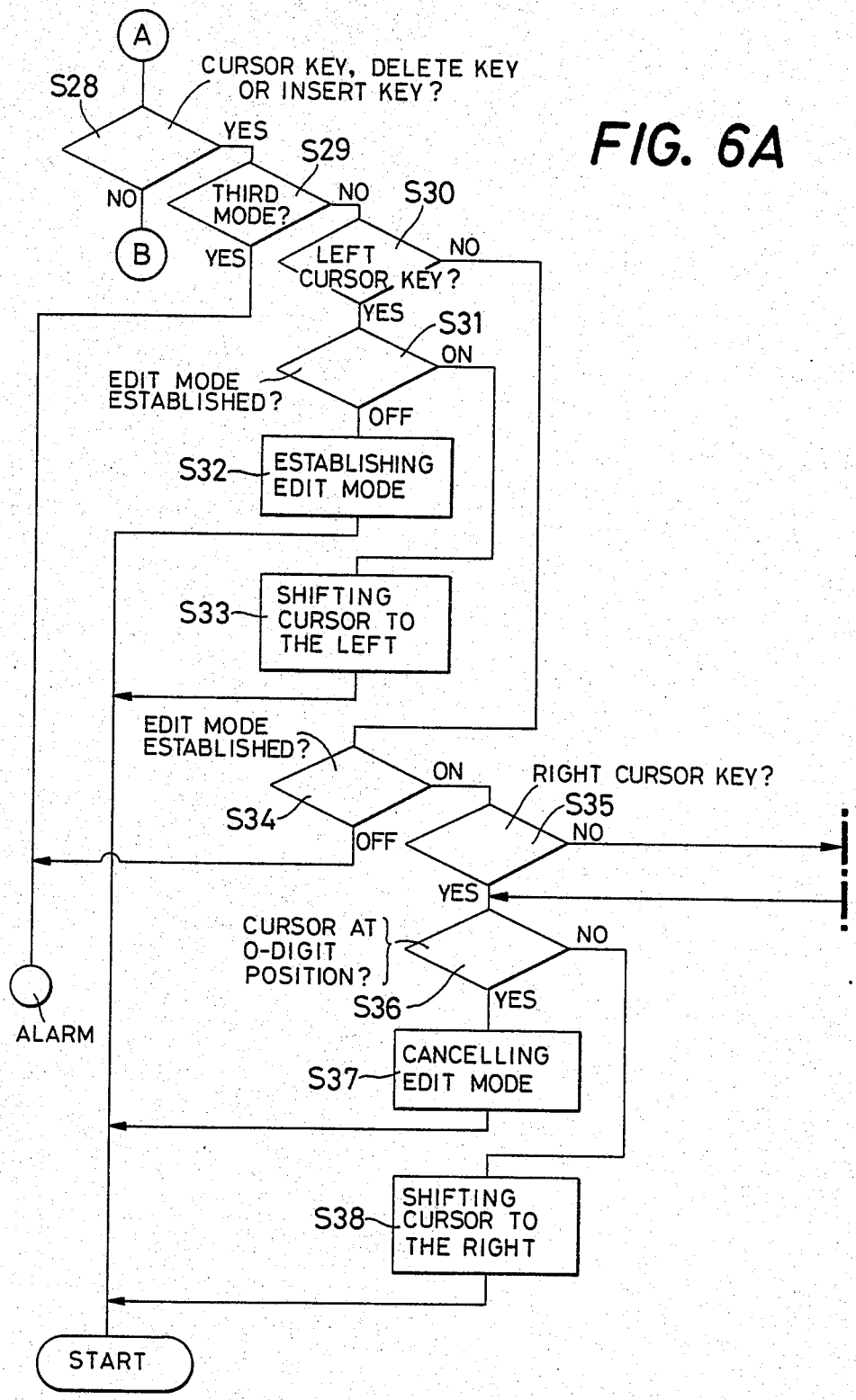
Figure 6B:
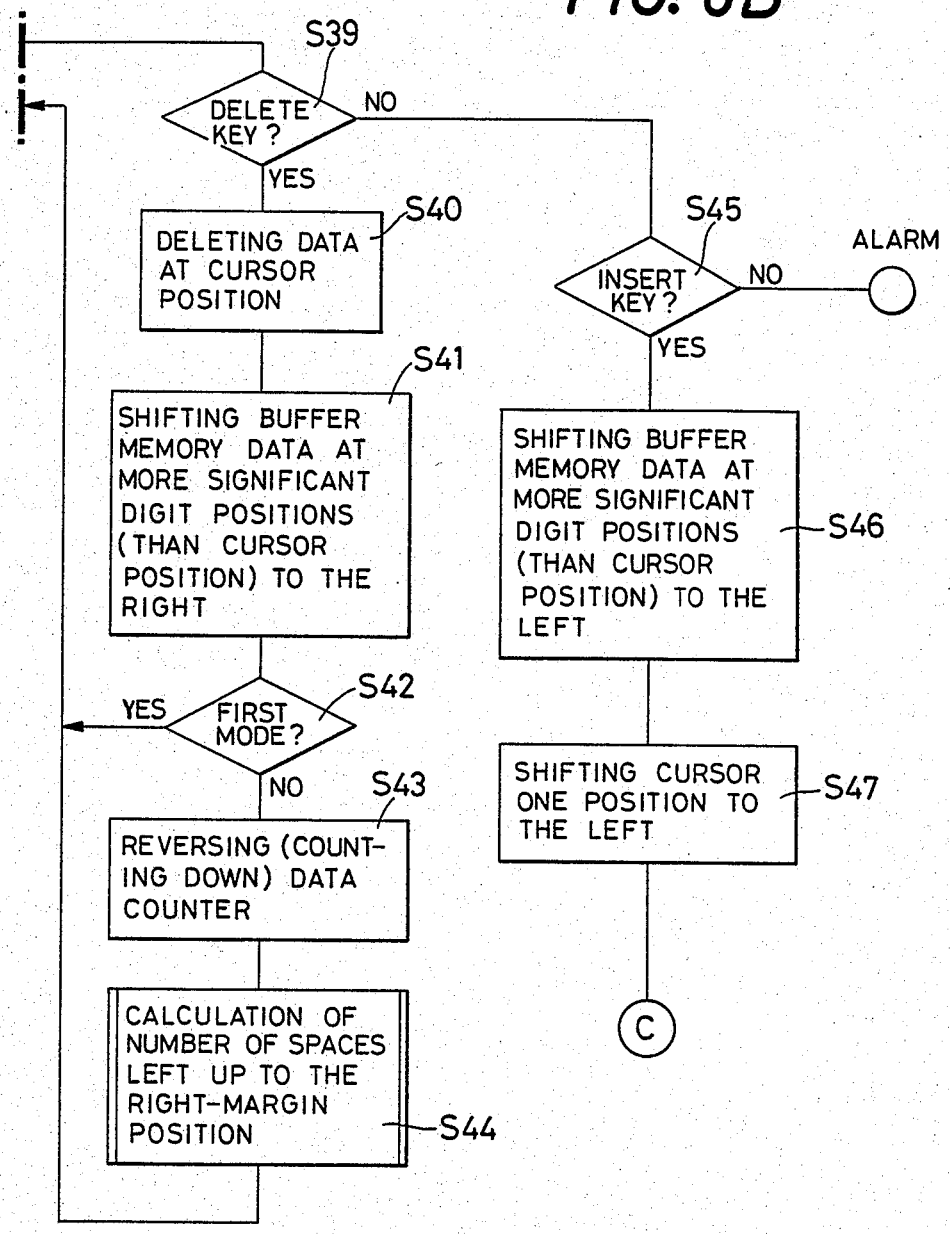

When the equality key 20 is depressed while the first and second calculation registers 36*d* and 36*e* are loaded with respective sets of code data each representing a numerical value, the data corresponding to the equality key 20 is judged in step 8 (FIG. 5A) to be function data, and the control goes to step 28 (FIG. 6A). Since the equality key 20 is not any one of the cursor, delete and insert keys 23, 24, 25, 26, the control then goes to steps S48 and S49 (FIG. 7), and then to step S50 in which all sets of code data stored in the buffer memory 36*a* are shifted out. Then, the main control unit 36 goes to steps S51 and S53, and to step S54 wherein the arithmetic operation designated by any one of the arithmetic operator keys 19 is performed based on the first and second operand data stored in the first and second calculation registers 36*d* and 36*e*. Then, a result of the arithmetic operation is written into the third calculation register 36*f* (S55). Subsequently, the pattern data representing the equality symbol and the result of calculation are written into the buffer memory 38*a* in the display control unit 38, and the equality symbol (=) and the numerals representing the result are displayed on the display unit 21 (S56). Now, the control returns via step S57 to the START position.

Figure 8:
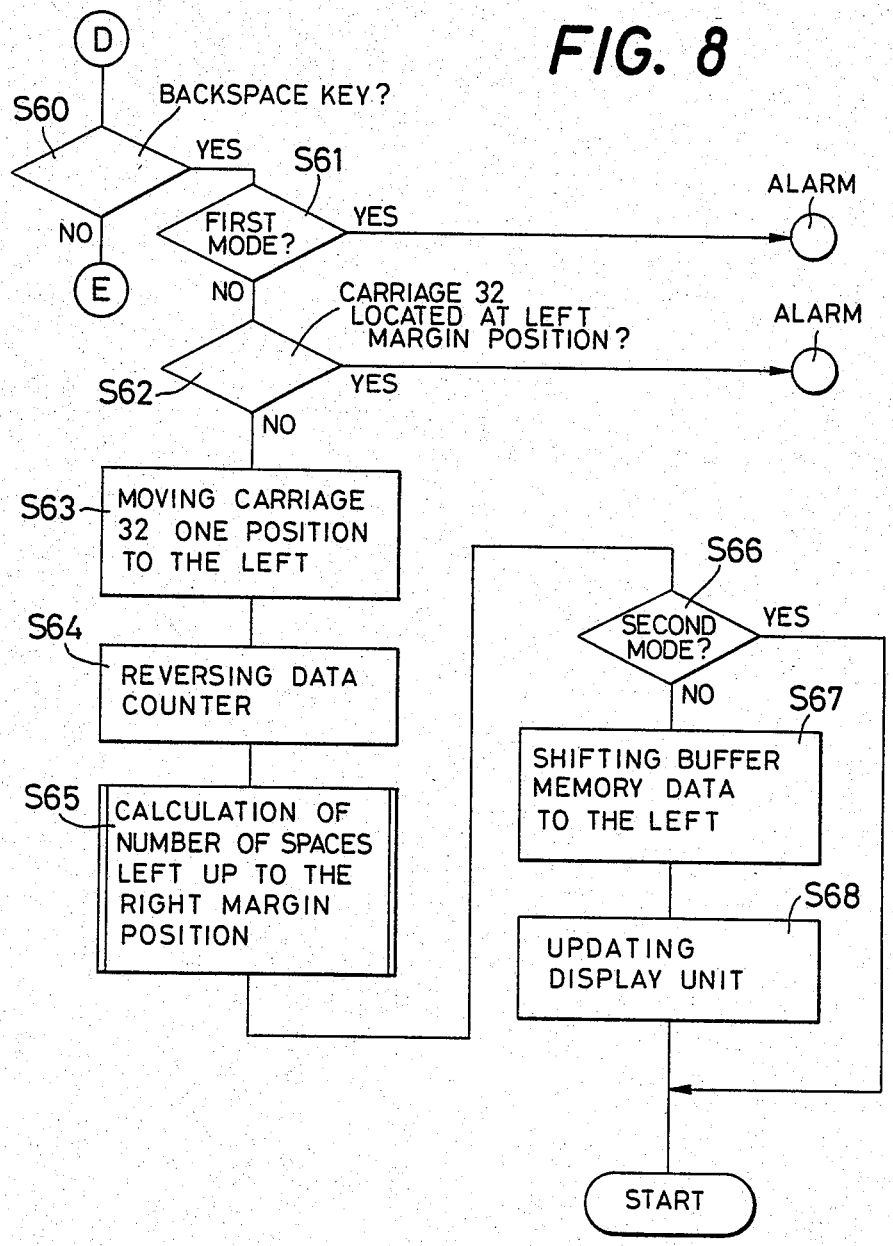
Figure 9:
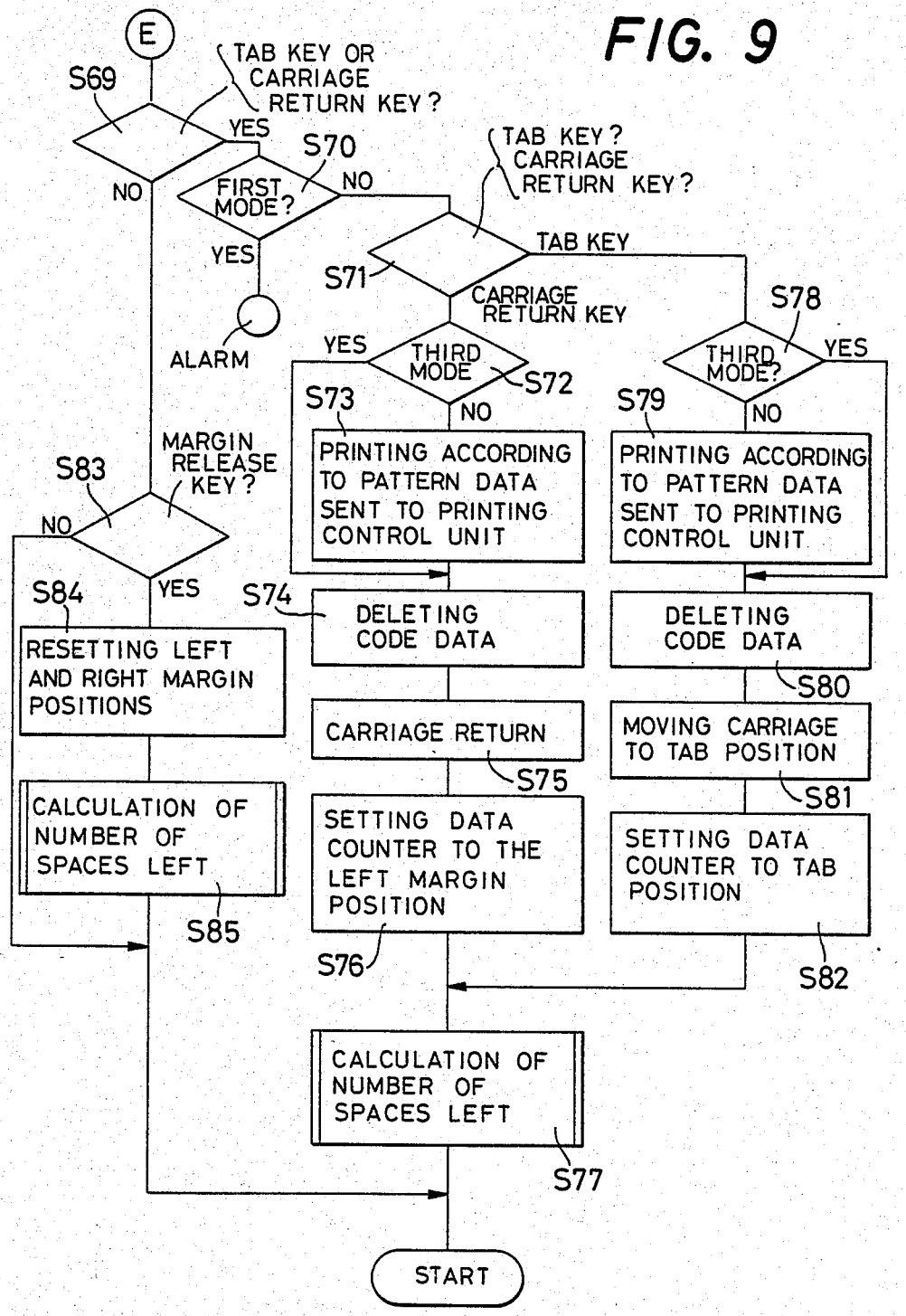

When the backspace key 5, carriage return key 6 or tab key 14 is depressed in the first mode, an alarm is constituted (S60, S61, FIG. 8 or S69, S70, FIG. 9).

The operation of the typewriter in the second mode is described below. This mode is selected when it is desired not only to calculate and display an arithmetic statement including letters, arithmetic symbols and numerical values such as operands and a result of calculation, but also to print the displayed statement for recording the calculating operations.

When the second mode is selected by the mode selection switch 18, a flag corresponding to the second mode is set up in the main control unit 36, and the unit 36 obtains an access to the first address of a storage area of the program memory 37*a* in which the program corresponding to the second mode has been stored. The selected second mode program is sequentially executed to perform the second mode of operation as hereinafter described.

Upon data entry through the keyboard 1 (S7, FIG. 5A), the code and pattern data corresponding to the keyed-in data are stored in the buffer memories 36*a* and 38*a*, respectively (S11), the characters (including spaces) represented by the pattern data are sequentially displayed on the display unit 21 (S12), and the data counter overflow is checked (S13) by comparing the current count of the data counter 36*g* with the present number of spaces between the left and right margin positions. When the current count is equal to or greater than the preset number of spaces, an alarm is constituted.

When the current count of the data counter 36*g* is smaller than the preset number, the data counter 36*g* is advanced to increase its count (S14). Then, the main control unit 36 goes to the previously indicated step S15. After the buffer memory 36*a* has overflowed due to excessive key entries (S17), the code data are shifted out sequentially and the corresponding pattern data in the pattern memory 37*b* are accessed (S18). The accessed pattern data are supplied to the printing control unit 39 and the heat generating elements of the thermal print head 34 are selectively activated according to the pattern data so as to print the corresponding characters on the paper sheet 31 (S22).

When the edit mode is established while in the second mode and the delete key 25 is depressed, the same routine as executed in the first mode is carried out. Namely, the code and pattern data in the buffer memories 36*a* and 38*a* corresponding to the current position of the cursor 21*a* on the display unit 21 are deleted (S40, FIG. 6B), and the code and pattern data stored at the more significant digit positions of the memories 36*a* and 38*a* are shifted one position to the right (S41). After the previously indicated step S42 is taken, the data counter 36*g* is reversed one count (S43) and the calculation in step S44 is conducted as previously discussed with reference to FIG. 10. The control then returns to the START POSITION.

Similarly, when the insert key 26 is depressed in the edit mode while in the second mode, the previously described steps S46 and S47 are taken, that is, the code and pattern data at the more significant digit positions of the memories 36*a* and 38*a* are shifted one position to the left, and the cursor 21*a* is shifted one position to the left. Then, the data counter 36*g* is advanced one count (S14) and the control returns to the START position.

As previously stated in association with the first mode of operation, the code and pattern data representing a space in the memories 36*a* and 38*a* corresponding to the cursor position are replaced by the code and pattern data corresponding to key entries which are made following the operation of the cursor key 23, 24 (S10, S23, FIG. 5A).

Depression of the equality key 20 in the second mode after entry of an arithmetic statement will cause all code data in the buffer memory 36*a* to be shifted out (S50, FIG. 7) and permit a printing operation according to the shifted-out data (S52). Further, the arithmetic operation is performed based on numerical data stored in the first and second calculation registers 36*d* and 36*e* (S54), the calculation result is stored in the third calculation register 36*f* (S55), and the equality symbol and the calculation result are displayed (S56). Then, the control unit 36 goes to step S57, and to step S58 wherein the number of digits of the calculation result is added to the current count of the data counter 36*g*, and the calculation in step S59 is accomplished in the same manner as in the first mode (S44, FIG. 6B, FIG. 10).

Upon depression of the backspace key 5 in the second mode (S60, FIG. 8), the main control unit 36 judges, according to the current count of the data counter 36*g*, whether the carriage 32 is located at the left margin position or not (S62). When the negative judgement is obtained, the carriage 32 is moved one position (space) to the left along the printing line (S63) and the data counter 36*g* is reversed (S64). Then, the calculation step S65 similar to the previously described step S44 (S59) is taken before the control returns to the START position via step S66 wherein the main control unit 36 checks if the second mode is selected or not.

When the carriage return key 6 or tab key 14 is depressed in the second mode, the main control unit 36 first checks to see which one of the keys 6, 14 is depressed (S69, S71, FIG. 9).

In case of the depression of the carriage return key 6 in the second mode (S71, S72), pattern data stored in the buffer memory 38*a* are accessed according to the code data stored in the buffer memory 36*a*, and a printing is effected according to the accessed pattern data (S73). Then, the code data in the buffer memory 36*a* are deleted and all characters displayed on the display unit 21 are deleted (S74). Then, the carriage 32 is returned to the left margin position preset by the left margin key 9 and the platen 30 is rotated to advance the sheet of paper 31 by a line space distance preset by the line space selection switch 27 (S75). The data counter 36*g* is reset in conformity with the left margin position (S76) and a calculation step S77 is performed as in step S44. Then, the control returns to the START position.

Upon depression of the tab key 14 in the second mode (S71, S78), on the other hand, the pattern data in the buffer memory 38*a* are accessed according to the code data stored in the buffer memory 36*a* and a printing is effected according to the accessed pattern data (S79).

Then, the code data in the buffer memory 36*a* are deleted and all characters displayed on the display unit 21 are depleted (S80). Subsequently, the carriage 32 is moved to the tab position established by the tab key 12 (S81), and the data counter 36*g* is updated in conformity with the tab position (S82). The control then goes to the calculation step 77 and to the START position. Step S85 similar to the step S77 is performed each time the margin release key 11 is depressed (S83, S84).

The third mode of operation of the typewriter of the invention is described next. This third mode is selected when it is desired to print characters by moving the carriage 32 as the characters are keyed in through the keyboard 1 in the same manner as used in a common typewriter in the art. In this third mode, the keyed-in characters are displayed as they are printed, and the margin and tab positions are readily established as needed. The third mode is particularly useful when a printing is effected on forms for various purposes, i.e., on printed documents with spaces left for insertion of information.

When the third mode is selected by the mode selection switch 18, a flag corresponding to the third mode is set up in the main control unit 36, and the unit 36 obtains an access to the first address of a storage area of the program memory 37*a* in which the program corresponding to the third mode has been stored. The third mode program is sequentially executed as described below.

Upon data entry through the keyboard 1 (S7, FIG. 5A), the main control unit 36 takes a path from step S8 to step S14 in the same manner as in the second mode. After the data counter 36*g* is advanced in step S14, the pattern data in the pattern memory 37*b* is accessed according to the code data written in the buffer memory 36*a* (S16, FIG. 5B), and the accessed pattern data is transferred to the display control unit 21 and the printing control unit 39. Thus, the corresponding characters are displayed on the display unit 21 and printed on the sheet of paper 31 (S12, S22).

In the event the cursor key 23, 24, delete key 25, insert key 26 or equality key 20 is operated in the third mode, an alarm is constituted (S29, S49) as indicated in FIGS. 6A and 7, whereby the editing and arithmetic operations described above are inhibited.

The backspace key 5, if depressed in the third mode (S60, FIG. 8), will cause the main control unit 36 to take a path from step S61 to step S65, and the code and pattern data in the buffer memories 36*a* and 38*a* are shifted one position toward the least significant digit (S67) while the display unit 21 is updated accordingly (S68) before the control returns to the START position.

When the carriage return key 6 or tab key 14 is depressed in the third mode (S69, FIG. 9), the code and pattern data in the buffer memories 36*a* and 38*a* are deleted (S74) or shifted according to the tab position (S80). The display unit 21 is updated and then the carriage return (S75) or carriage movement to the tab position (S81) is effected before the calculation step 77 is executed.

Figure 11A:
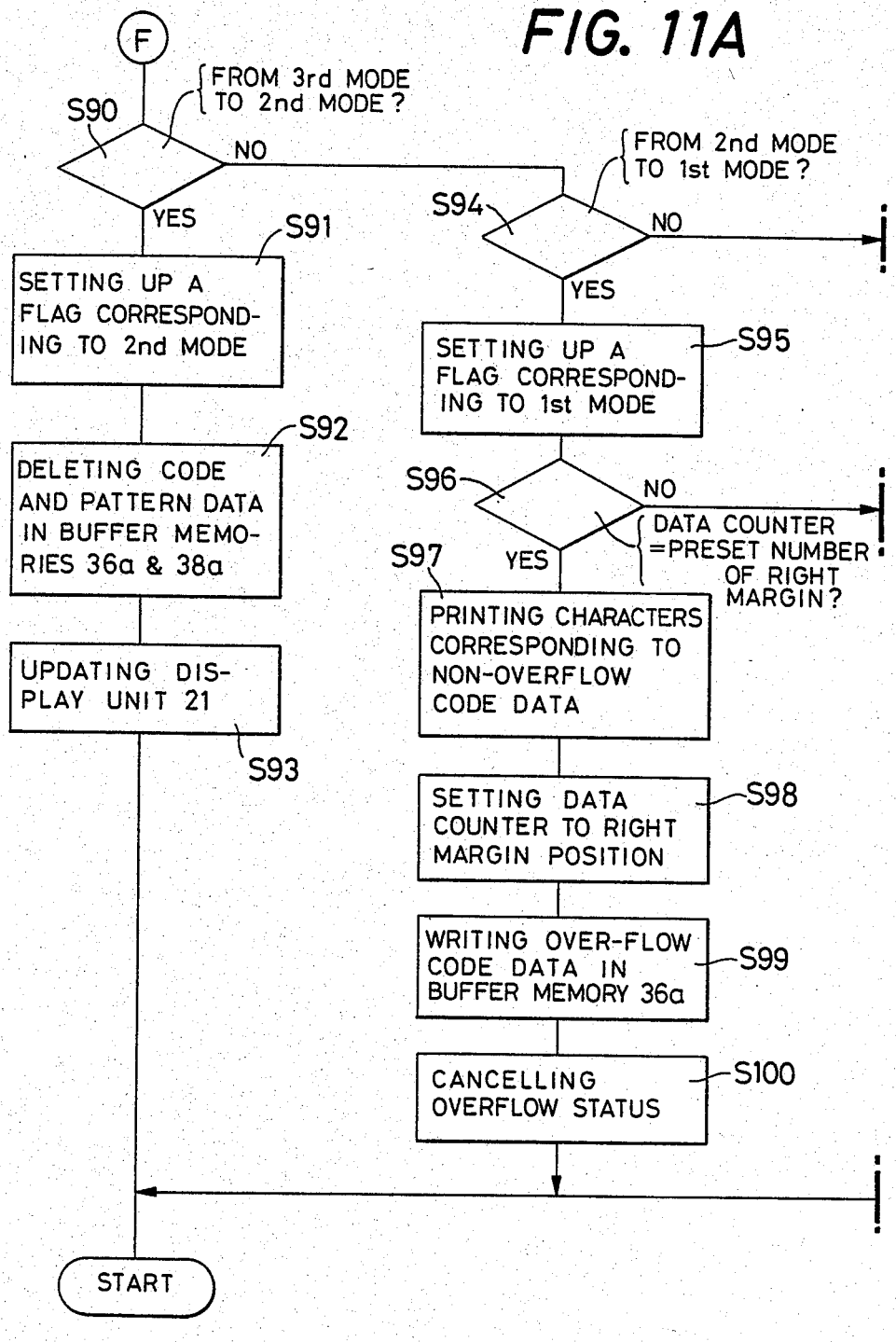
Figure 11B:
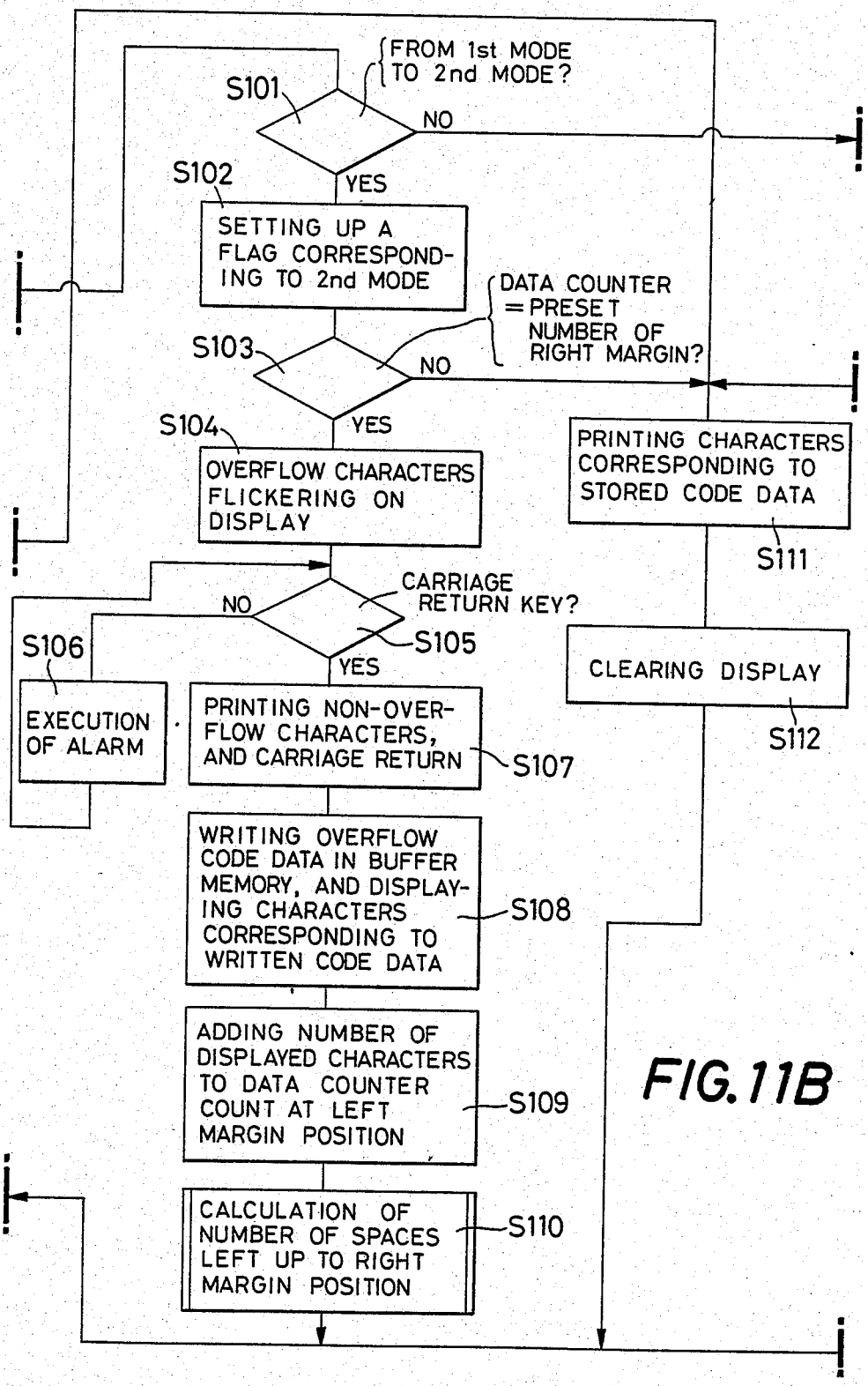
Figure 11C:
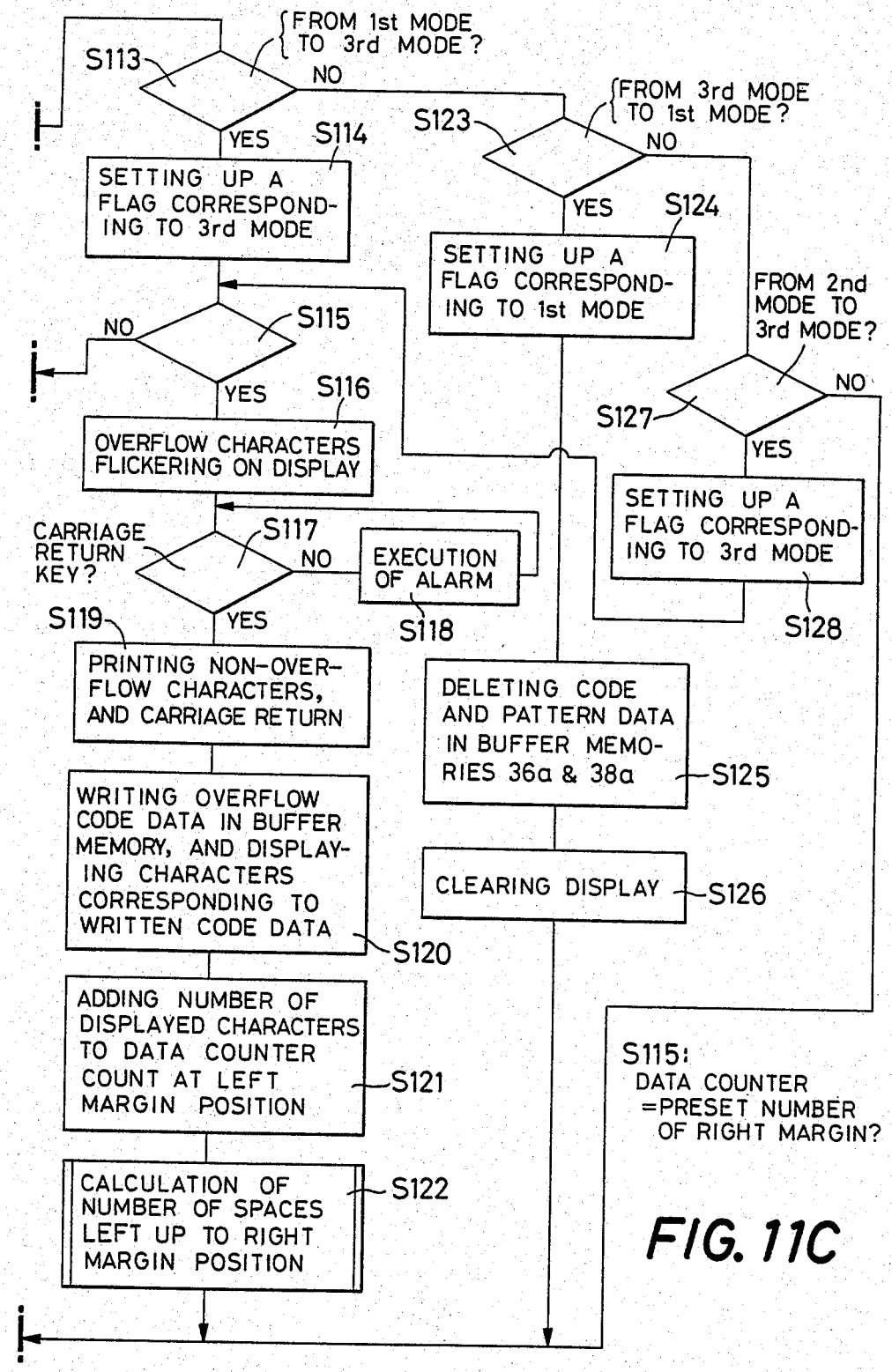

Referring to FIGS. 11A–11C, there are shown events which occur when the mode of operation of the typewriter is changed from one to another by the mode selection switch 18.

Upon changing the operation mode from the third mode to the second mode (S90), the main control unit 36 sets up a flag corresponding to the second mode (S91), deletes all code and pattern data stored in the buffer memories 36*a* and 38*a* (S92) and updates the display unit 21 (S93). Then, the control returns to the START position.

When the operation mode is changed from the second mode to the first mode (S94), the main control unit 36 sets up a flag corresponding to the first mode (S95), and judges whether one printing line has overflowed or not i.e., whether the right margin position would have been reached if the code data in the buffer memory 36*a* was executed (S96). When the above judgement is negative, the pattern data in the pattern memory 37*b* is accessed according to the code data in the buffer memory 36*a* and the characters are printed according to the accessed pattern data (S111). The code data stored in the buffer memory 36*a* is deleted and the display unit 21 is cleared (S112). When the above judgement in step S96 is positive, the pattern data in the pattern memory 37*b* is accessed according to the non-overflow code data in the buffer memory 36*a* and the characters are printed according to the accessed pattern data (S97). Then, the data counter 36*g* is set in conformity with the right margin position (S98) and the overflow code data is written into the buffer memory 36*a* (S99). The characters corresponding to the overflow code data stop flickering on the display unit 21 (the overflow status is cancelled in step S100) and the display is updated (S100). Finally, the control returns to the START position.

Upon changing the operation mode from the first mode to the second mode (S101), the main control unit 36 sets up a flag corresponding to the second mode (S102) and judges whether one printing line has overflowed or not (S103). If the above judgement is negative, a printing operation is conducted according to the code data stored in the buffer memory 36*a* (S111), and the display unit 21 is cleared (S112) before the control returns to the START position.

When the above judgement in step S103 reveals that one printing line has overflowed, the overflow characters are displayed in a flickering fashion (S104), and the main control unit 36 then checks to see if the carriage return key 6 has been operated or not (S105).

In the event the carriage return key 6 has been depressed, the non-overflow characters are printed and the carriage return motion takes place (S107). The overflow code data is stored in the buffer memory 36*a* and the corresponding characters are displayed (S108). The number of the displayed characters is added to the count of the data counter 36*g* at the left margin position (S109). Then, a calculation step S110 similar to S44 (FIG. 10) is executed before the control returns to the START position.

When the above judgement in step S105 is negative, i.e., when a key other than the carriage return key 6 has been operated, an alarm is constituted (S106) and the control returns to the same judgement step S105.

When the first mode is changed into the third mode by the mode selection switch 18 (S113), the main control unit 36 sets up a flag corresponding to the third mode (S114) and judges whether one printing line has overflowed or not (S115). If this judgement is positive, the control unit 36 makes the overflow characters flicker on the display unit 21 (S116) and judges whether the carriage return key 6 has been operated or not (S117).

In the case where the key 6 has been operated, the non-overflow characters are printed and the carriage 32 returns to the left margin position (S119). The overflow code data is stored in the buffer memory 36a, and the characters corresponding to the stored code data are printed and displayed (S120). The number of the displayed characters is added to the count of the data counter 36g at the left margin position (S121), and a calculation step S122 similar to step 44 (FIG. 10) is executed before the control returns to the START position.

In the case where the data counter 36g has not overflowed when the step S115 is executed, a printing operation is performed according to the code data stored in the buffer memory 36a (S111), and the display unit 21 is cleared (S112) before the control is restored to the START position.

In the event that a key other than the carriage return key 6 has been depressed and that the negative judgement is obtained in the above step S117, an alarm is constituted (S118) and the same step S117 is repeated to make a judgement whether the carriage return key 6 has been operated.

When the operation mode is changed from the third mode to the first mode (S123) by the mode selection switch 18, the main control unit 36 sets up a flag corresponding to the first mode (S124) and deletes all code data stored in the buffer memory 36a (S125) as well as clears the display unit 21 (S126). Then, the control returns to the START position.

When the second mode is changed to the third mode by the switch 18 (S127) a flag corresponding to the third mode is set up (S128), the steps S115 through S122 are performed.

Figure 12:
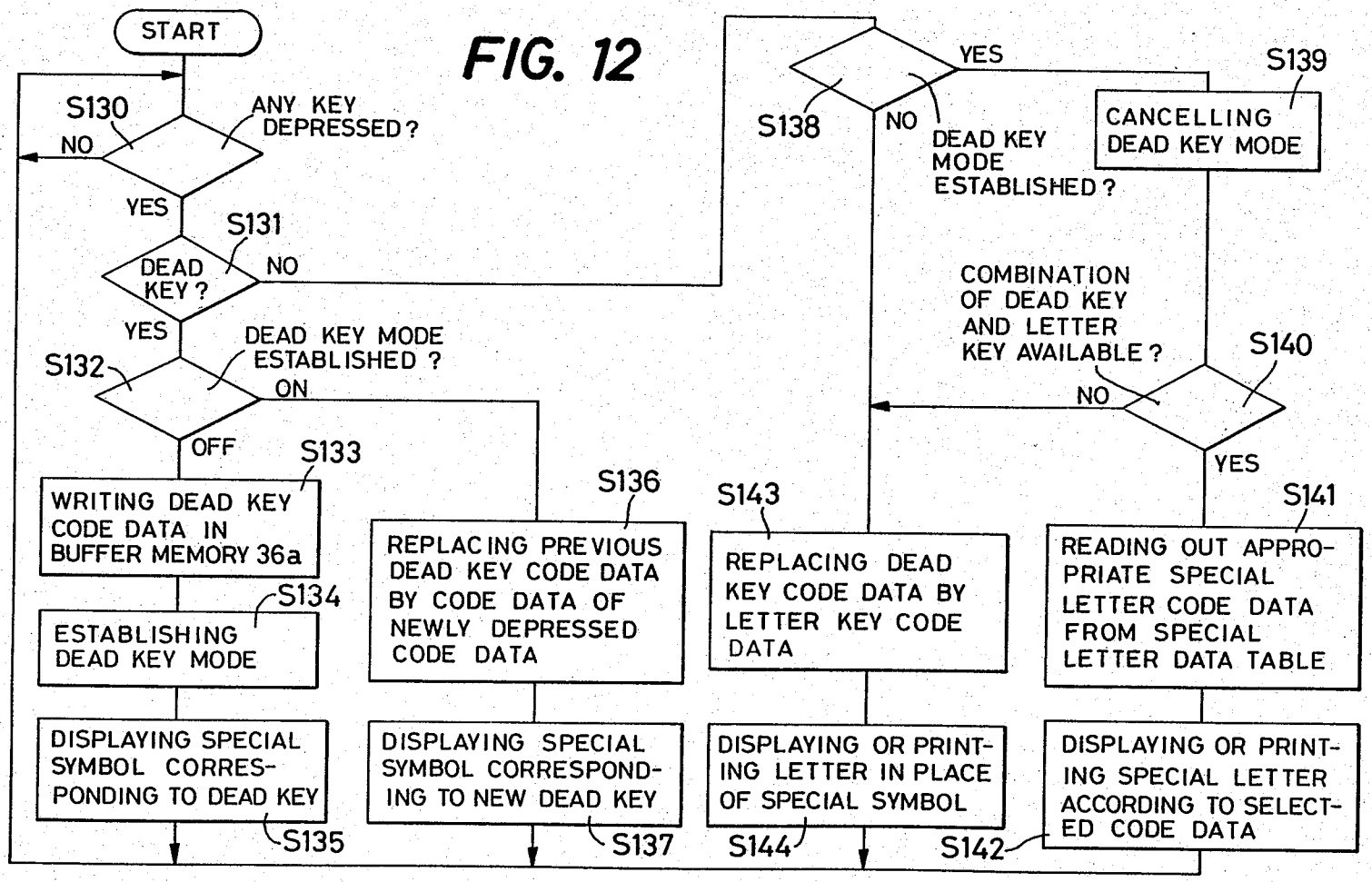

There are represented in FIG. 12 events of operation which take place when a key bearing one of the special symbols is depressed in any one of the three modes while the second shift key 8 is in the operated position. The special symbols include: " ¨ " (Umlaut), " ´ " (accent aigu), " ˆ " (accent circonflexe), " ˜ " (tilde), etc. The keys having these special symbols are referred to as "dead keys" or "special symbol keys" 2' depressed with the second shift key 8, and the depression of the dead keys will not cause the carriage 32 to move along the printing line.

When one of the dead keys is activated (S130, S131), the main control unit 36 judges whether a dead key mode has been established or not (S132). If the dead key mode has not already been established, the code data representing the depressed dead key is stored in the buffer memory 36a (S133) and the dead key mode is established (S134). Subsequently, the special symbol, e.g., " ¨ " represented by the stored code data is displayed (S135).

In the event another dead key bearing, for example, " ´ " is depressed (S131) following the dead key " ¨ ", the code data representing the special key " ¨ " which has been stored in the buffer memory 36a is replaced by the code data which corresponds to the newly depressed dead key " ´ " (S136). Accordingly, the special symbol " ¨ " displayed on the displayed unit 21 is changed to " ´ " (S137). Then, the control returns to the START position.

If the entry of the special symbol " ¨ " is followed by an entry other than the special symbols, for example, letter "A", the dead key mode is cancelled (S138, S139) and the main control unit 36 judges whether a combination of the special symbol " " and the letter "A" is available in a Special Letter Data Table stored in a "table memory" within the control unit 36, which Table represents a listing of possible combinations of the special symbols and letters, some of the combinations constituting special letters such as "Ä" and "Ñ" (S140).

When the combination is available, the main control unit 36 obtains an access to the Special Letter Data Table to write in the buffer memory 36a the code data corresponding to the special letter "Ä" (S141) and supplies the corresponding pattern data to the display control unit 38 or printing control unit 39 (S142), whereby the special letter "Ä" is displayed or printed (S142).

When the special symbol entry " ¨ " is followed by an entry other than the special symbols, for example, letter "B", the main control unit 36 judges in step S140 that the Special Letter Data Table does not contain a combination of the special symbol " ¨ " and the letter B, i.e., a special letter "B". In this instance, the code data representing " ¨ " previously stored in the buffer memory 36a is replaced by the code data representing the newly entered letter "B" (S143), whereby the letter "B" is displayed or printed (S144). Then, the control returns to the START position.

Suppose the special symbols " ¨ " and " ˜ ", and a letter "N" are successively entered, the latter entry " ˜ " of the special symbols is regarded as an effective special symbol whose combination with the letter "N" is checked against the Special Letter Data Table to judge whether that combination, i.e., special letter "Ñ" is available or not (S140). Since this special letter is available, it is printed or displayed according to the corresponding code data (S142).

If a combination of a special symbol (last one when plural special symbols are successively entered) with a letter is judged to be absent against the Special Letter Table, the special symbol or symbols are ignored and only the entered letter is printed or displayed, thereby preventing an erroneous output of special letters which are not actually available.

Figure 15:
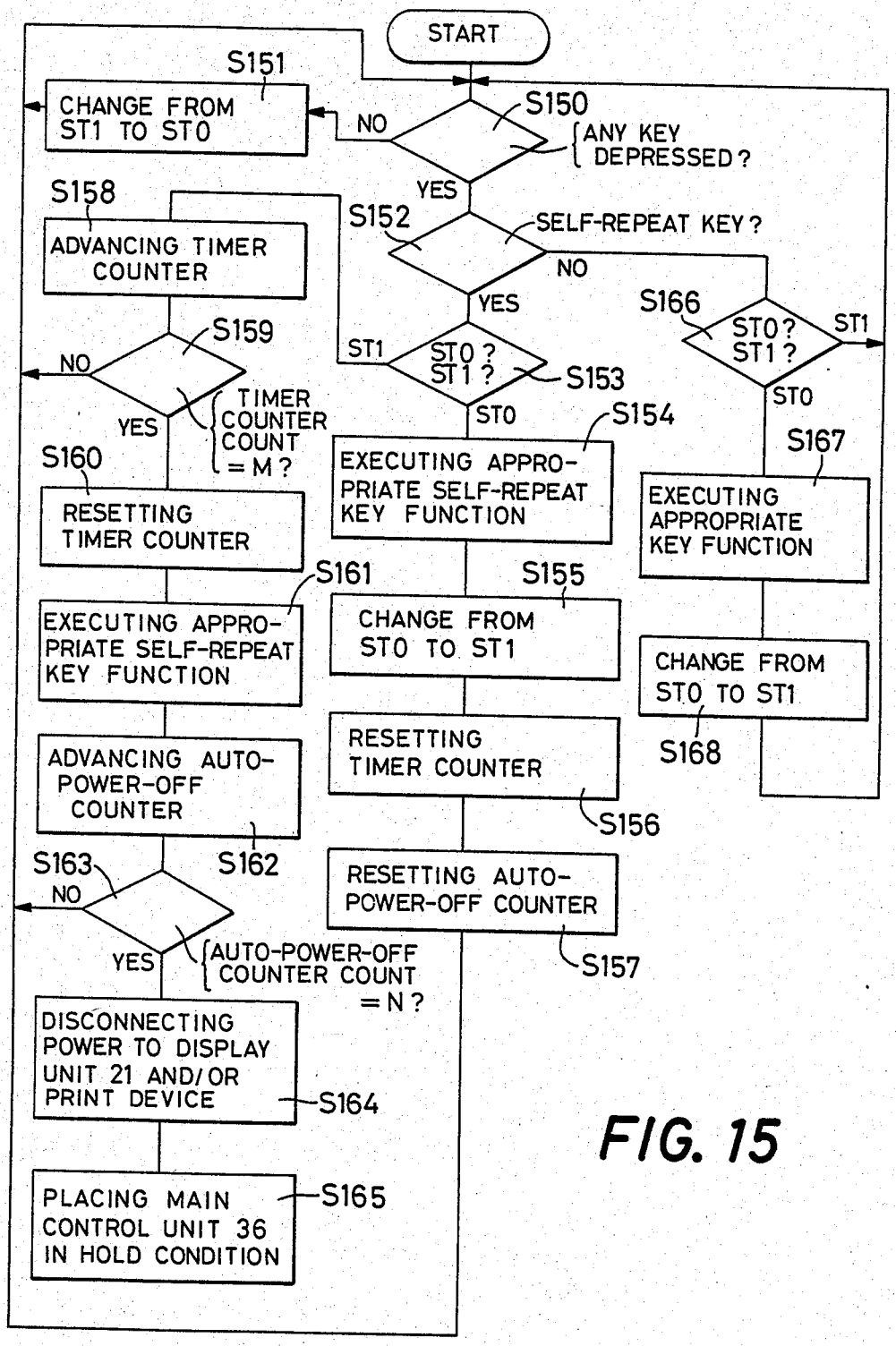
FIG. 15 is a flow chart illustrating an automatic power disconnecting function of the typewriter in connection with self-repeat keys.

Referring to FIGS. 14 and 15, an automatic power disconnecting function of the present typewriter is described. This function is available when a self-repeat key, i.e., carriage return key 6, paper forward key 15 or paper backward key 16 or repeat key 17, is continuously held in its depressed position for more than a reasonable period. When the function is executed, the power to the display unit 21 is automatically removed while the main control unit 36 is placed in its hold condition. It is noted here that the repeat key 17 is considered as a self-repeat key which repeats a function designated by other keys such as letter keys and some function keys (e.g., backspace key 5) which are depressed prior to continuous depression of the repeat key 17.

As illustrated in FIG. 14, there are two possible states ST0 and ST1 in the main control unit 36. The state ST0 is established while the self-repeat key is in its depressed position, and state ST1 is established while the self-repeat key is in its normal release position. The currently established state which is detected by periodic scanning will vary according to whether the self-repeat key is depressed or not.

When one of the self-repeat keys, for example, paper forward key 15 is depressed (S150, S152), the control unit 36 first judges whether the state ST1 has been previously established or not, i.e., which one of the states ST0 and ST1 is established before depression of the key 15 (S153). The state ST0 is established before any repeat key is depressed (S151). If the state ST0 has been established, the function assigned to the depressed self-repeat key is executed (S154) before the state ST0 is changed into the state ST1 (S155), i.e., the platen 30 is rotated to advance the paper sheet 31 by one line space distance. Then, a timer counter 36*h* and an Auto-Power-Off counter 36*i* are reset (S156, S157), and the control returns to the START position.

If the paper forward key 15 is held depressed in the above condition, the timer counter 36*h* is advanced (S158) to count the number of scannings of the key positions which are repeated during the continuous depression of the key 15.

When the current count of the timer counter 36*h*, i.e., the numer of the scanning has reached a preset number M (S159) the timer counter 36*h* is reset (S160) and the assigned function of the paper forward key 15 is performed (S161). Then, the Auto-Power-Off counter 36*i* is advanced (S162) and the current count of this counter 36*i* is checked to see if it has reached a preset number N (S163) to count the number of execution of the paper forward motion.

When the count of the Auto-Power-Off counter 36*i* is less than the present number N, the control returns to the START position. The above steps of operation are repeated and the paper forward motion is effected each time the preset number M has been reached, until the preset number N is reached.

When the count of the Auto-Power-Off counter 36*i* has reached the preset number N, the main control unit 36 removes power from the display unit 21 (S164) and/or the printing device while holding the code and pattern data stored in the buffer memories 36*a* and 38*a*, and at the same time switches the Hold terminal from HIGH-level to LOW-level to keep the unit 36 in the HOLD condition (S165). When the Hold terminal is set at the LOW-level, the normal typewriter operation can not be performed but the code data in the buffer memory 36*a* is held.

In the event a self-repeat key, e.g., carriage return key 6 is depressed while in the Hold condition, the Hold condition is cancelled with the Hold terminal switched to the HIGH-level.

If a key other than the self-repeat keys is depressed, the control unit 36 judges which one of the states ST0 and ST1 has been established (S166). When the state ST0 has been established, the function assigned to the depressed key is performed (S167) and the state is changed from ST0 to ST1 (S168). The control then returns to the START position. When the state ST1 has been established the control returns to the START position without execution of any function.

In summary, the automatic power disconnecting function serves to inhibit the continuously depressed self-repeat keys from performing their function after the respective function has been repeated a preset number of times, thereby providing a saving of power consumption of the typewriter which is powered by the battery 45.

What is claimed is:

1. An electronic typewriter, which comprises:

a keyboard having a multiplicity of keys including letter keys, numeral keys, arithmetic operator keys, and function keys including an equality key, said keyboard generating code signals corresponding to said keys when said keys are depressed;

a photoelectric display device for indicating characters corresponding to said letter, numeral and arithmetic operator keys;

a printing device for printing said characters along a line of printing;

main control means, connected to said keyboard, and said display and printing devices, for processing said code signals in one of a first mode, a second mode and a third mode, to supply to said display and printing devices sets of pattern data corresponding to said code signals; and manually operated means for selectively establishing said first, second and third modes, said main control means, when placed in said first mode, performing an arithmetic operation which is defined in a statement including letters, at least one arithmetic operator and plural numerical values entered through said letter, numeral and arithmetic operator keys, respectively, said main control means in said first mode further directing said display device to display said statement and a result of said arithmetic operation, and making it possible to edit the displayed statement and said result for correction and/or change thereof, said main control means, when placed in said second mode, making it possible to perform the items of operation in said first mode and directing said printing device to print said statement and said result of arithmetic operation, and said main control means, when placed in said third mode, directing said printing device to print said characters as the characters are entered.

2. An electronic typewriter as recited in claim 1, wherein said main control means includes a program memory which stores therein three different programs corresponding to said first, second and third modes, said manually operated means generating selection signals to select said first, second and third modes.

3. An electronic typewriter as recited in claim 1, wherein said main control means includes a buffer memory of a digit capacity equal to that of said display device, which buffer memory stores therein code data corresponding to said code signals, said main control means further including a register which stores therein said code data shifted out of said buffer memory, said main control means supplying to said display device said sets of pattern data which correspond to the code data stored in said buffer memory.

4. An electronic typewriter as recited in claim 1, wherein said main control means includes arithmetic means having a first calculation register, a second calculation register and a third calculation register, and wherein, when said statement includes more than two numerical values, more than one arithmetic operator and an equality symbol corresponding to said equality key, said main control means stores a first one of the numerical values in said first calculation register, and a second one of said numerical values in said second calculation register, said arithmetic means performing, upon entry of a second one of the arithmetic operators, a mathematical operation of said first and second numerical values according to a first arithmetic operator entered between said first and second numerical values, and storing a result of said mathematical operation in said first calculation register, a third one of the numerical values being stored in said second calculation register, said arithmetic means performing, upon entry of said equality symbol, another mathematical operation of said result in said first calculation register and said third numerical value according to said second arithmetic operator, and storing a result of said another mathematical operation in said third calculation register, said printing device printing the content of said third calculation register when the typewriter is placed in the second mode.

5. An electronic typewriter as recited in claim 1, wherein said main control means comprises a microcomputer.

6. An electronic typewriter as recited in claim 1, wherein said main control means regards each of said numerical values as an operand only when said each of the numerical values is entered last prior to any one of said at least one arithmetic operator and an equality symbol corresponding to said equality key.

7. An electronic typewriter as recited in claim 1, wherein said keys on the keyboard further include keys serving as special symbol keys bearing special symbols, and said main control means further includes a table memory storing therein special letter data which represents a listing of possible combinations of said special symbols and said letters, each of said combinations forming a special letter, upon each entry of said special symbol followed by any one of said letters, said main control means checking against said listing whether the combination of the entered special symbol and letter is available in the listing or not, and when the combination is available, directing said printing device to print the special letter according to the special letter data.

8. An electronic typewriter as recited in claim 1, wherein said function keys include self-repeat keys and said main control means causes functions of said self-repeat keys to be repeated while the self-repeat keys are kept depressed, said main control means including a counter counting a number of repetitions of said functions, and inhibiting said self-repeat keys from performing their functions after the count of said counter has reached a preset number.

9. An electronic typewriter which comprises:

a keyboard having a multiplicity of keys including letter keys and special symbol keys each bearing a special symbol;

a printing device printing characters including letters corresponding to said letter keys and said special symbols; and main control means, connected to said keyboard and said printing device, for controlling the operation of the typerwriter, said main control means including a table memory which stores therein special letter data representing a listing of possible combinations of said special symbols and said letters, each of said combinations forming a special letter, upon each entry of one of said special symbols followed by one of said letters, said main control means checking against said listing whether the combination of the entered special symbol and letter is available in said listing or not, and only when said combination is available, directing said printing device to print said special letter according to the special letter data.

10. An electronic typewriter as recited in claim 9, wherein said main control means reads out from said table memory said special letter data to direct the printing device to print said special letter.

11. An electronic typewriter as recited in claim 9, wherein said main control means includes a buffer memory which stores therein data representing the special symbol, and wherein when said combination is not available, said main control means replaces said data in said buffer memory with data representing said one of the letters.

12. An electronic typewriter as recited in claim 9, wherein said main control means includes a buffer memory which stores therein data representing the special symbol, and when said one of the special symbols is followed by another special symbol, said main control means replaces said data in said buffer memory with data representing said another special symbol.

13. An electronic typewriter which comprises:

a keyboard having a multiplicity of keys comprising character keys and function keys including at least one self-repeat key;

a printing device printing characters corresponding to said character keys which have been depressed; and main control means, connected to said keyboard and said printing device, for controlling the operation of the typewriter, said main control means causing a function of said self-repeat key to be repeated while the self-repeat key is kept depressed, including a counter counting a number of repetitions of said function, and inhibiting said self-repeat key from performing its function after the count of said counter has reached a preset number, even when said self-repeat key is kept depressed.

14. An electronic typewriter as recited in claim 13, wherein said main control means comprises a buffer memory storing therein code data corresponding to said characters, and means for switching a hold terminal thereof between a high level at which the typewriter can be normally operated, and a low level at which the typewriter can not be operated normally but said code data is maintained in said buffer memory, said switching means selecting said low level when said count has reached said preset number.

15. An electronic typewriter as recited in claim 13, wherein said main control means removes power from said printing device when said count has reached said preset number.

16. An electronic typewriter as recited in claim 13, which further comprises a display device indicating said characters entered through said character keys, and wherein said main control means removes power from said display device when said count has reached said preset number.

17. An electronic typewriter as recited in claim 14, wherein said switching means switches said hold terminal from said low level to said high level when any one of said character keys is depressed while said hold terminal is at said low level.

18. An electronic typewriter as recited in claim 13, wherein said self-repeat keys comprises at least one of a carriage return key, a paper forward key, a paper backward key, and a repeat key which permits function of said character and function keys to be repeated when the repeat key is depressed following the character and function keys.

* * * * *